US007147789B1

(12) United States Patent
Morley et al.

(10) Patent No.: US 7,147,789 B1
(45) Date of Patent: Dec. 12, 2006

(54) PROCESS FOR CONTROL OF CONTOURS FORMED BY ETCHING SUBSTRATES

(75) Inventors: Catherine A. Morley, Lester Prairie, MN (US); Mark P. Sponholz, Minneapolis, MN (US); Steven R. Young, Hutchinson, MN (US); Steven A. Fank, Darwin, MN (US); Jacob D. Bjorstrom, Hutchinson, MN (US)

(73) Assignee: Hutchinson Technology Incorporated, Hutchinson, MN (US)

( * ) Notice: Subject to any disclaimer, the term of this patent is extended or adjusted under 35 U.S.C. 154(b) by 124 days.

(21) Appl. No.: 10/662,934

(22) Filed: Sep. 15, 2003

Related U.S. Application Data

(63) Continuation-in-part of application No. 10/040,282, filed on Oct. 19, 2001, now abandoned.

(60) Provisional application No. 60/241,639, filed on Oct. 19, 2000.

(51) Int. Cl.
*B44C 1/22* (2006.01)

(52) U.S. Cl. ..... 216/11; 41/47; 41/59; 430/5

(58) Field of Classification Search ..... 216/11, 216/41, 47, 59; 430/5
See application file for complete search history.

(56) References Cited

U.S. PATENT DOCUMENTS 5,362,584 A * 11/1994 Brock et al. ..... 430/5
5,421,934 A * 6/1995 Misaka et al. ..... 216/59
5,846,442 A * 12/1998 Pasco ..... 216/41
5,935,451 A * 8/1999 Dautartas et al. ..... 216/2
6,423,239 B1 * 7/2002 Cathey et al. ..... 216/11

* cited by examiner

*Primary Examiner*—Shahim Ahmed
(74) *Attorney, Agent, or Firm*—Faegre & Benson, LLP

(57) ABSTRACT

The present invention provides a process for controlling the contour of a feature in a transition area made by etching a substrate. This process includes applying a patterned resist mask to the substrate to form a plurality of mask openings and mask land areas. The mask land areas are sized and spaced to a control the contour of a feature on the substrate.

30 Claims, 25 Drawing Sheets

VIEW 8A

13 A

13 B

13 C

13 D

= resist

= resist

A

B

PROCESS FOR CONTROL OF CONTOURS FORMED BY ETCHING SUBSTRATES

CROSS-REFERENCE

The present application is a continuation-in-part of U.S. application Ser. No. 10/040,282, filed Oct. 19, 2001, abandoned which, in turn, claims the benefit of U.S. provisional application Ser. No. 60/241,639, filed Oct. 19, 2000. Both of these applications are incorporated herein by reference.

BACKGROUND

This invention generally relates to processes to form components or parts by etching or partially etching a substrate. In particular, the invention provides a process of selecting sizes and spacings of resist land areas and open areas to control the topography of an etched complex substrate.

Partial depth etching is based on the principles of isotropic etching and the fluid dynamics of etching. Isotropic etching is defined as etching which occurs equally in all directions. As etching of an exposed substrate surface begins, a side wall develops at the boundary or edge of the resist mask land area (area of the substrate that is not being etched or removed by contact with a suitable etchant) and the resist mask open areas (area of the substrate that is being etched or removed by contact with a suitable etchant). Once the formation of the side wall begins at the land area edge, nothing exists to prevent the etching away of the side wall underneath the resist mask land area. This etching of the side wall is commonly referred to as "undercutting".

The depth of etch divided by the amount of undercut is known as the "etch factor" and describes the shape of an etched recess at a given point in an etch time. Factors influencing the etch depth include such variables as time of etch, spacing distance (width of exposed substrate) between edges or borders of resist mask open areas and land areas, orientation between resist mask openings and resist mask land areas, resist thickness, etchant chemistry and method of etchant application.

One of the important variables in etching is the influence of the spacing distances between edges of the resist mask land areas. Theoretical and experimental studies indicate a strong dependence of the rate of the depth of etch versus the original space width between resist mask edges. Fluid modeling suggests that as the depth of the etched depression forms a cavity, the flow of etchant within the cavity creates one or more flow eddies. This phenomenon causes a reduction in the etch rate, because reactant by-products must traverse these eddies to escape the cavity. This influence increase as the etched cavity deepens.

Studies also indicate that the minimum width of etch openings in a photoresist mask that can be produced is limited or restricted by the widths of the resist mask open areas and the widths of the resist mask land areas. As the widths of the open areas and the land areas are diminished, the amount of undercut will begin to exceed half of the width of the land areas and undercutting from both sides will cause the resist land area to become detached from the substrate. These factors are discussed in Allen et al., Quantitative Examination of Photofabricated Profiles; Part 2—Photoetched Profiles in Stainless Steel, The Journal of Photographic Science, Vol. 26, 1978, pages 72–76.

The etch rate is dependent on several variables. However, the etch rate is particularly dependent on the original width between edges of resist mask openings when the openings have widths of less than about 0.15 mm. For opening widths of less than about 0.15 mm, the etch factor is largest for the widest spacing between edges of resist mask openings, and the etch factor is smallest for the narrowest spacing between edges of resist mask openings. The etch rate is most retarded in narrower spaces between edges of resist mask land areas, such as narrow grooves, slots, small spaces, openings or holes. In such small geometric configurations, spent etchant cannot be easily replenished.

For a particular etchant chemistry and etchant transport method, there exists a critical spacing dimension, referred to as "critical etch space." When the spacing widths between edges of resist mask land areas are reduced to less than the "critical etch space", the rate of etching decreases. When the spacing widths between edges of resist mask openings are greater than the "critical etch space", the rate of etching remains essentially constant. The use of properly sized and spaced resist mask open and land areas has been used to create different thicknesses in substrates. U.S. Pat. No. 5,846,442 reports using appropriately sized and spaced resist mask open and land areas to create two or more areas of different partial etch depths on a single part or substrate without having to use multiple etching stages or steps. This reported process allows fabricating at least two areas of differing thicknesses in the etched substrate using a single etching step.

Although U.S. Pat. No. 5,846,442 generally reports methods of partial etching, it would be beneficial to provide a method of controlling a contour in a transition area of an etched or partial etched complex part or component.

SUMMARY OF THE INVENTION

The present invention provides a process for controlling the contour of a feature in a transition area made by etching a substrate. This process includes applying a patterned resist mask to the substrate to form a plurality of mask openings and mask land areas. The mask land areas are sized and spaced to control the contour of a transition area of the feature because the size and spacing of the land areas provide an etch depth in the substrate at the transition area that is less than an etch depth at an adjacent etched or partially etched area of the substrate. Further, the width and spacing of land areas provide a slower etch rate than an etch rate at an adjacent etched or partially etched area of the substrate. After applying the patterned resist mask to the substrate, the substrate may be etched to form a contoured feature at the transition area. The contoured feature may be, for example, a sharp edge, a corner, a taper, a slope, or a rounded feature. The contoured feature may also include a substrate surface having a desired texture.

Another embodiment of the invention is a process for controlling a cross section or topography of an etched feature in a substrate at a transition area. In this embodiment, the process includes applying a resist mask to portions of the substrate to form one or more masked openings and a plurality of masked land areas. The size, shape, and spacing of the land areas are selected to control a contour of the transition area of the etched feature. Transition areas may include a fillet radius, a rounded or sharp corner or edge, a slope, a complex tapered geometry or a textured topography.

Yet another embodiment of this invention is a single step exposure or partial etching process to provide a feature on the substrate. This process includes applying a resist mask to selected portions of the substrate, and patterning a mask area of a predetermined planar size and shape at a transition area of the substrate to form one or more mask open areas and one or more mask land areas. The size, shape, and spacing of the one or more mask land areas and the size, shape, and spacing of the one or more mask open areas reduces or increases corner rounding or provides for the formation of a complex geometry of a feature at the transition area.

In a further embodiment, the present invention provides a process for forming a feature on a substrate, in which a resist mask having at least first, second and third mask areas is applied to the substrate. The first mask area is of a first predetermined planar size and planar shape to form a plurality of first mask openings and first mask land features dimensioned to provide a first area etch depth The second mask area is of a second predetermined planar size and planar shape to form a plurality of second mask openings and second mask land features dimensioned to provide a second area etch depth, wherein the second area etch depth is reduced relative to the first area etch depth. The third mask area is of a third predetermined planar size and planar shape to form a plurality of third mask openings and third mask land features which are sized and spaced to control a contour of a transition area positioned adjacent to the first and second mask areas. The patterned substrate is then etched such that the substrate corresponding to the second mask area is etched to a lesser depth than the substrate corresponding to the first mask area, and the transition area adjacent to the first and second mask areas comprises a contoured feature. More than 3 mask areas may be employed in alternative embodiments.

In yet a further embodiment, the present invention provides a method of forming a tapered substrate in which a patterned resist mask is applied to a substrate, the resist mask including a plurality of mask openings and mask land areas sized and shaped to provide an incrementally increasing etch rate from a first end of the substrate to a second end of the substrate. The substrate is then etched such that the etch depth incrementally increases from the first end to the second end of the substrate.

Still further, an embodiment of the present invention provides a method of forming a textured surface on a substrate in which a patterned resist mask is applied to the substrate to form a plurality of mask openings and mask land areas that are sized and spaced to control the texture of the substrate surface. The substrate is then etched to provide a textured substrate surface.

DETAILED DESCRIPTION

Figure 1:
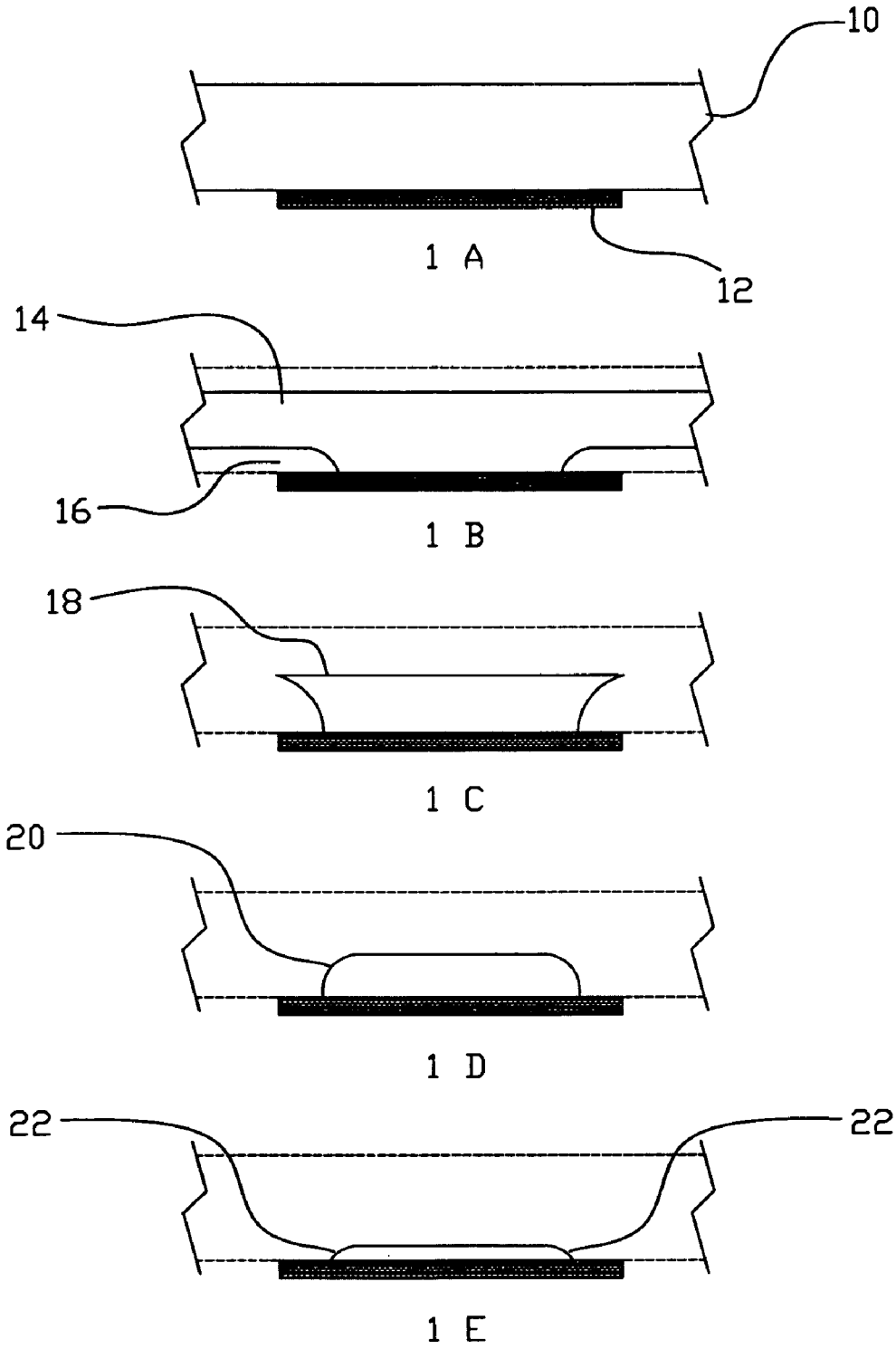
FIGURE 1 PRIOR ART
FIG. 1 illustrates a side view of a substrate undergoing a conventional etch process.

The present invention uses resist features and the size and shape of resist mask land and open areas, in order to affect, alter or slow the etch rate at selected areas of a substrate. Control of the etch rate, in turn, provides control of the topography, depth, cross sectional profile, or other form or contour (these terms will be referred to collectively as "contour") of the etched substrate. Notably, this invention may be used to improve transition area corners and edges by affecting (e.g. reducing) the amount of roundoff typically seen in these areas as well as to provide for the formation of complex geometric configurations in a complex part or component. Furthermore, no sequential or multiple etching or other process steps are needed to realize this improvement.

More specifically, an embodiment of the invention relates to methods or processes for controlling the contour of an etched or partial etched area of a substrate, specifically a transition area. The term "transition area" refers to a portion or area of a substrate between either a non-etched and an etched area, a portion between a non-etched area and a partially etched area, a portion between a non-etched area and a fully etched area, or a portion between a partial etched area and another partial or fully etched area. A transition area may have any of a variety of topographical shapes or forms, for example a corner, a sharp corner, a rounded corner, an edge, a gradual or steep slope, a curve such as a fillet radius or a tapered segment. If a corner is desired, it most preferably has controlled corner rounding. The present invention may be used to control corner rounding and to improve the shape (e.g. sharpness) of corners and edge-shaped transition areas if desired.

The substrate may be any substrate that can be processed with etching techniques. Partial etching is common on parts such as head suspension assemblies and components used in personal computer systems including but not limited to the flexure, loadbeam and spring regions of the head suspension assembly, but the present method may be applied to any etching or partial etching application.

In particular, head suspensions are very precise metal springs that hold read/write heads, such as magnetic or optical heads, adjacent rotating disks in a disk drive. A conventional disk drive contains a spindle that is rotated by an electric motor at several thousand revolutions per minute. One or more magnetically coated recording disks are mounted on at axially spaced positions along the spindle. A head actuator column is positioned adjacent to the rotating disks. The head actuator column typically has a plurality of actuator arms and each actuator arm supports one or more head suspensions that extend in cantilever fashion from the actuator arm to distal ends of the head suspension.

The head suspensions are typically comprised of a proximal support region that attaches the head suspension to an actuator arm, a distal load region that supports that read/write head, and an intermediate spring region that biases the load region and the read/write head toward the rotating disk. The read/write heads are attached to sliders at the distal ends of each of the head suspensions. The read/write heads of this type usually do not contact the surface of the rotating disk (although contact heads and/or sliders are also used), but instead "fly" on the slider at a precisely maintained distance above the rotating disk surface. The head suspension maintains the read/write head at a correct flying distance from the surface of the rotating disk because of an equilibrium created between the upward force of an air bearing created by air driven under the slider by the rotation of the disk, and a downward spring bias force applied by the head suspension that is dependent on the head suspension's vertical stiffness.

The surface of a data storage disk is not perfectly flat. The principal function of a head suspension flexure or load beam gimbal is to be compliant in the pitch and roll directions to maintain the slider at its proper altitude and to follow disk surface fluctuations as well as to reduce the effect of load beam motion on the slider. Typically, the pitch motion is permitted by rotation of the slider about a transverse axis to the head suspension and the roll motion is permitted by rotation of the slider about a longitudinal axis to the head suspension.

As slider sizes decrease in size, the supporting air bearing created beneath these sliders also decreases in size, resulting in a decrease in the lift force exerted on the slider. With the lift force of the air bearing decreasing, head suspensions must be designed to be more sensitive to the external torque applied to the slider. The head suspension flexure or gimbal must also have a high lateral (transverse) stiffness to prevent unintended motion of its attached read/write head due to acceleration and deceleration forces exerted on the slider when the head suspension is rapidly moved to position the read/write head at different radial locations on the disk. Even though sliders are becoming smaller and their mass is becoming smaller, the increased acceleration and deceleration forces cannot be ignored. Also, a high lateral stiffness is required to prevent motion of the slider due to the air flow created by the rotating disk. As disks in disk drives are positioned closer together and their revolution speeds are increased, the air flow created by their rotation is increased. Even though the side surface area of the slider is decreasing, it is not enough to counter the increase in air flow.

It is also necessary that a head suspension have a high vertical stiffness or handling stiffness. This stiffness is required to minimize vertical movement of the head suspension and possible damage to the head suspension from routine handling and ultrasonic cleaning processes.

As head suspension flexures or gimbals are developed having a low pitch and roll stiffnesses for smaller sliders, steps must be taken to avoid reducing the lateral stiffness of the flexure or gimbal without also negatively affecting vertical stiffness. The ability to provide complex contours such as tapers, edges, contours, and cross sections according to the present invention allows control of the lateral and vertical stiffness characteristics, which are coupled to their pitch and roll stiffness characteristics.

In another embodiment, the invention relates to the use of partial etching and the selection of open and land resist areas to facilitate partial etching on very thin substrates to provide complex topographies, textures or geometric configurations. A thin or very thin substrate may be a substrate that is too thin to be partially etched by other techniques, but that may be partially etched with the methods of the invention, using resist features to affect, e.g., slow, the etch rate at selected areas of a substrate, to control the cross sectional profile and thickness of the very thin etched substrate. Examples of very thin substrates include substrates that are less than 50 microns in thickness, for example less than 40 microns or less than 25 microns. The composition of a very thin substrate may be any metal, for example copper (typically 18 microns thick) and copper alloys, steel such as stainless steel (e.g. 300 series), gold and gold alloys, aluminum and aluminum alloys or other metals or alloys such as constantan. Alternatively, the substrate may be formed from a variety of polymers, for example, polyimides, acrylics, epoxies, urethanes or liquid crystal polymers. Such polymers may function as dielectric layers between conductors and a structural ground plane, as core layers between structural load beam components (e.g. a laminate), as protective coatings, or as structural layers (e.g. a stiffener on a head suspension).

According to the invention, a metal substrate 18 microns thick may be partially etched in a single etching step using a selection of open and resist land areas ("grayscale") to retard etch rate at selected areas for partial etching. The sizes and separations of the resist open and land areas are chosen to selectively retard etch rate, and result in a partial etch of areas of the substrate to a thickness of, for example, from 2 to 5 microns, while other areas are partially etched or etched fully through.

According to the invention, a plurality of mask openings and mask land areas of a photoresist mask are provided at areas of a substrate where it is desired to partially etch the substrate, or to etch a transition area, or at any other area where etching rate and contour are to be controlled. The term "plurality" as it refers to mask openings and mask land areas includes resist mask patterns with one mask land area and multiple mask openings, one mask opening and multiple mask land areas or multiple mask land areas and multiple mask openings. Contour of an area of a substrate such as a transition area may be controlled by selecting the sizes, shape, and placement of a photoresist material. The size and shape of resist land areas and open areas will reduce the rate of etch at that area, and will therefore allow control of the amount of material etched from that area, the depth of etching at that area, and the cross-sectional profile of the etched area.

In one embodiment, the substrate may be subjected to an etching or partial etching step prior to applying the photoresist mask to initiate etching of certain portions of the substrate. The photoresist mask may then be applied, followed by a subsequent etching step. Alternatively, etching of the substrate may be performed in a single step.

Suitable land areas may include a wide variety of shapes and sizes. In one embodiment, the land areas are generally circular areas of resist and appear as round dots or flat pedestals. In another embodiment, the land areas and open areas form a mesh pattern. The land areas and open areas may be produced by conventional methods of selective exposure of well known photoresist materials that are developed by exposure to ultraviolet light. The size and shape of the land and open areas are selected to affect etch rates and etch depths and to provide desired depth, topography, cross section, or contour of features formed on the etched substrate. By spacing the pedestals of appropriate sizes and areas at appropriate distances, the etch rate in affected areas is impeded, causing these areas to etch at a slower rate. The areas of the dots or pedestals are small enough so that these areas are fully undercut during the etching process and fall off of the substrate. The height of a dot or pedestal, i.e., the thickness of the resist, may also be selected to be useful in achieving a desired contour of the etched substrate. For example, the thickness of the dot or pedestal may be in the range from about 5 to 15 microns or may be about 9 microns in height. After the dots or pedestals fall off, any additional etching will smooth out the surface roughness of the substrate. Final etch depth, surface appearance, and cross-sectional profile, may be controlled by selecting the size and spacing of the resist land areas, e.g., pedestals (along with other factors of the etch process, such as exposure time). Small dots or pedestals will result in smoother surfaces, but will fall off quickly, limiting their effect on the final etch depth. Smaller spaces between the dots or pedestals reduce the etch rate in the area of the pedestals which will decrease the final etch depth.

A specific example of a pattern of resist land and open areas is a plurality of circular land areas provided at a transition area, preferably as rows of dots or pedestals. The exact sizes, shape, number, and spacing of the pedestals may be empirically determined by routine experimenting on a specific substrate. Such routine experimentation allows a determination of the best pattern, sizes and shapes for providing a desired depth, size, shape, topography or other contour of the transition area, including relative corner sharpness or roundness. As an example, placing several rows of circular land areas or pedestals near the edge of a partial etched region of a head suspension loadbeam reduces corner rounding typically seen on these parts. The theory of how this works is that in general an etch rate at a corner is relatively higher or faster than at other (open) areas of the substrate. According to the invention, photoresist material placed at an edge of a transition area or corner will retard etching at that area and result in an improved, desired contour, such as a squared or less rounded corner.

In a particular embodiment of the present process, circular pedestals of resist with diameters of 55–70 microns, spaced 20–30 microns apart, have been effective. However, useful results may be achieved with almost any resist area shape, including, but not limited to lines, squares, rectangles, triangles, hexagons, mesh patterns, etc.

Additionally, combinations of different patterns may be used in an etching step to achieve various complex contours over a substrate. In embodiments incorporating multiple resist patterns, transition patterns may be formed at the intersection between different patterns to achieve a gradual transition between pattern shapes.

Generally, larger land area sizes result in rougher finished surfaces, while smaller land areas have little affect on the final contour, or are very difficult to expose and develop. Size and spacing of the land areas depend greatly on desired etch depth and original metal thickness, so a large range of sizes and spacings may be effective. Land areas ranging from 10 to 100 microns with spaces between 10 to 50 microns have been used with desired degrees of effectiveness.

The texture of the substrate surface may also be controlled by the method described herein. The resist pattern and etch time may be manipulated to increase or decrease topography as desired. For example, in certain embodiments it may be desirable to form a substrate with minimal topography by utilizing comparatively smaller land areas and/or longer etch times. In alternate embodiments, a certain level of topography may be achieved by utilizing comparatively larger land mask areas and/or shorter etch times. Forming textured regions on a substrate may be desirable in certain applications to provide a region of improved adhesion to another material.

The process of the present invention may be used to etch parts which require specific contours or cross section of any etched area, partial etched area, or transition area. Better control of partial etched areas allows better control of performance characteristics of an etched part. The invention allows partial etching of very thin substrates that would otherwise be difficult to perform in single step etching.

The figures describe and illustrate the process of the present invention in more specific detail.

FIG. 1 illustrates a side view of a substrate undergoing a conventional partial etch process. The different phases of the process are illustrated through five stages, identified as views 1A, 1B, 1C, 1D and 1E. View 1A illustrates a block of substrate 10 coated on the bottom with a layer of photoresist 12 before or prior to the start of the etching process. View 1B is an illustration of the same substrate and photoresist after about 25 percent of the etching process has been completed. View 1B illustrates that the top 14 of the substrate, having no photoresist, has been generally uniformly etched, and that the bottom has been etched around the layer of photoresist, and even to some degree under the photoresist as an area of undercut 16. View 1C shows further progress of the etching process, wherein the sides and top of the substrate have been etched away to leave a feature of the substrate 18. Further, view 1D shows a side view of the substrate after about 75 percent of the etching process has been completed, wherein the sides and top of the substrate have been etched away to leave a feature of the substrate 20 or rounded block. Finally, view 1E shows a side view of the end product of the etching process, an etched steel rectangular block with substantially rounded corners 22.

Figure 6:
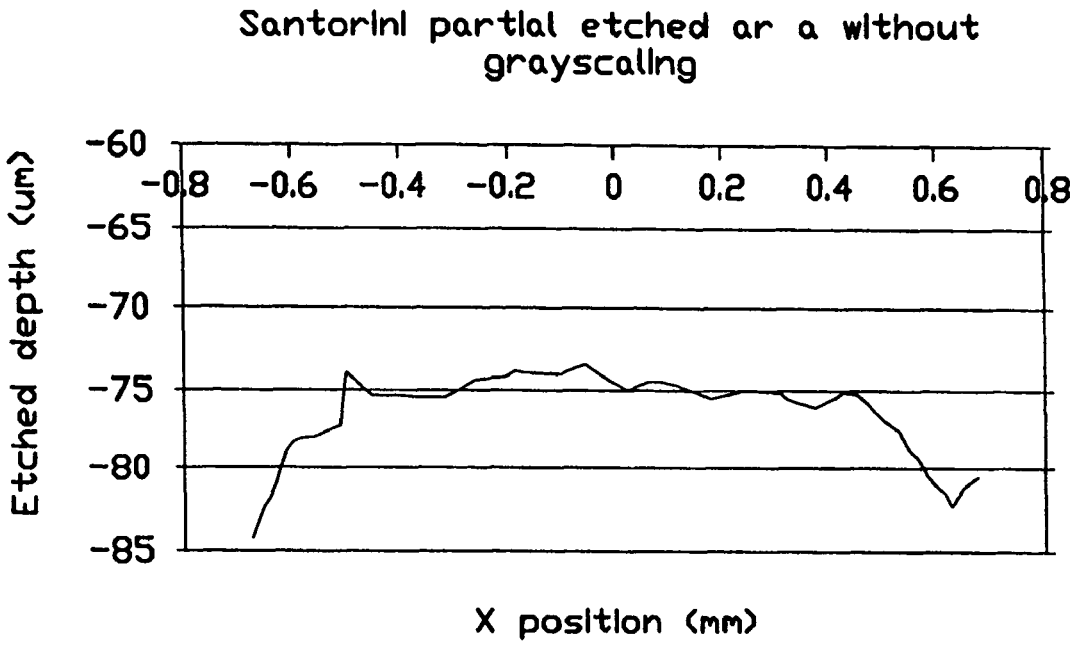
FIG. 6 is a graph of the cross sectional height of a corner illustrated in FIG. 1.

FIG. 6 is a graph of the cross sectional height (etch depth) of a cross section of view 1E. In this graph, where the corners of the final feature or etched block are rounded, the measurement of FIG. 6 falls off at the edges.

Figure 2:
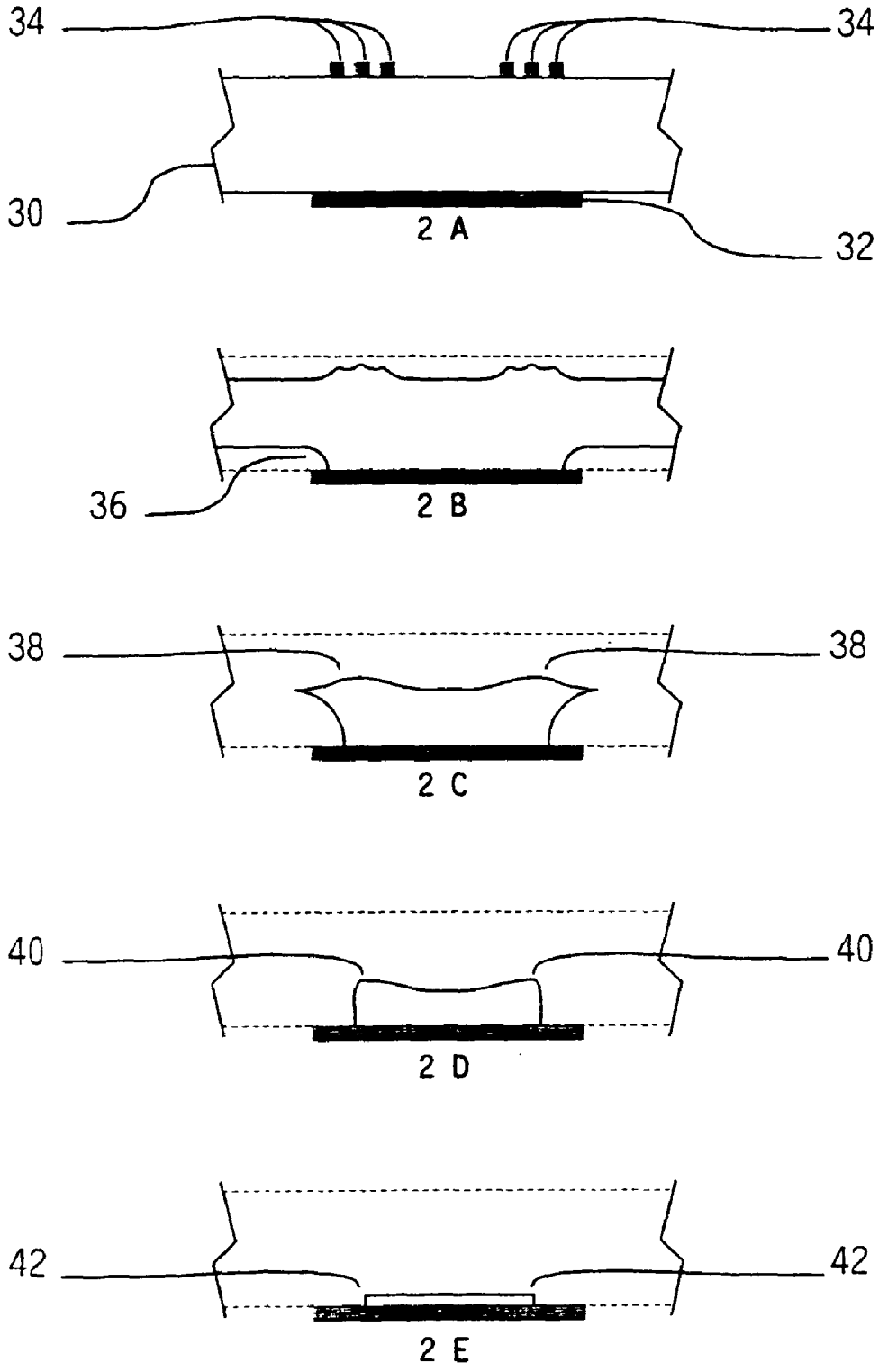
FIG. 2 illustrates a side view of a substrate undergoing an etch process of this invention.

FIG. 2 illustrates a side view of a substrate undergoing a partial etch process according to the invention, using separated or spaced-apart photoresist land areas on the top of the substrate, to retard etch rate and control the contour or profile of the topography of the substrate at a transition area. The process is illustrated through 5 stages, identified as views 2A, 2B, 2C, 2D and 2E. View 2A illustrates a block of substrate 30 before or prior to the start of the etching process. The substrate is coated on the bottom with a continuous layer of photoresist 32 and on top includes a number of photoresist land areas 34, generally located above the edges of the bottom photoresist and in the transition area or corner of the feature that will be formed during the process. View 2B is an illustration of the same substrate and photoresist after about 25 percent of the etching process has been completed. View 2B illustrates that the top of the substrate has been etched uniformly except for the areas under and surrounding the land areas of photoresist 34, which have been etched at a reduced rate on average and that the bottom has been etched around the layer of photoresist, and even to some degree under the photoresist as an undercut area 36. View 2C illustrates further progress of the etching process, wherein the land areas have fallen off, leaving a block with relatively less etching at the top corners 38, relative to the substrate of view 1C. View 2D illustrates the substrate after about 75% percent of the etching process has been completed. In this view, the sides and the top of the substrate have been etched away, leaving a block with relatively less etching at the top corners 40 as well as less accentuated rounding relative to the block view of 1D. View 2E illustrates a side view of the end product of the etching process, an etched steel rectangular block with relatively square corners 42 at the transition area, which are a result of the resist land areas on the top of the substrate controlling or reducing the etch rate below the land areas in the transition area or corner of the feature. The size and shape of the land areas were chosen to cause the substantially square corners.

Figure 7:
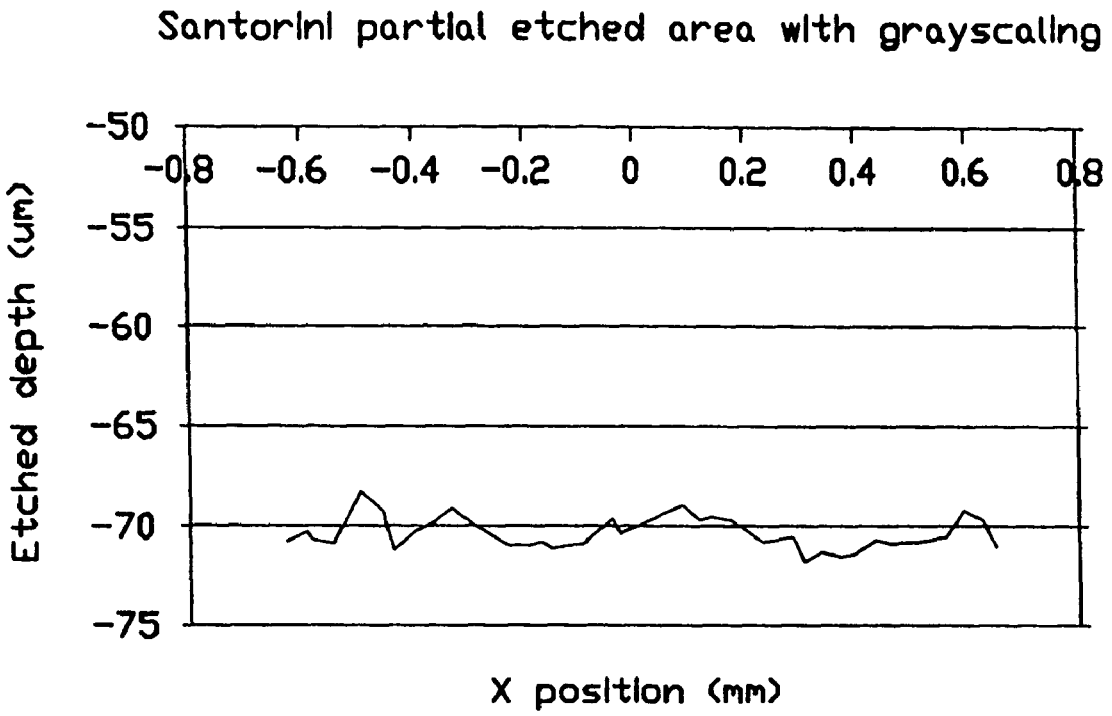
FIG. 7 is a graph of the cross sectional height of a corner illustrated in FIG. 2.
Figure 8:
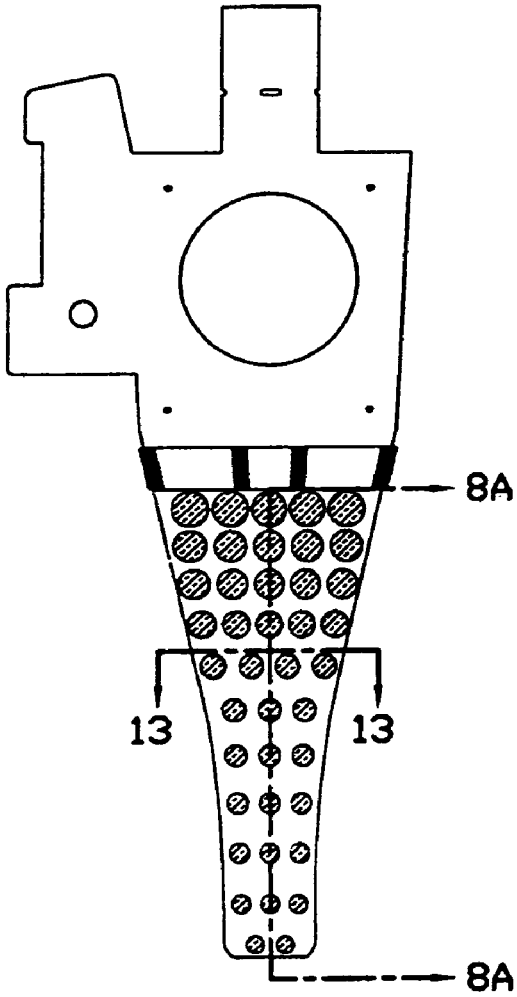
FIG. 8 is an illustration of a resist mask pattern having a pattern of resist areas for use in an etch process of this invention that provides a tapered complex part having a taper along its length as illustrated by view 8A.
Figure 8:
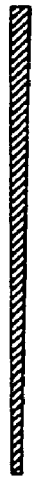

FIG. 7 is a graph of the cross sectional height (etch depth) of a cross section of view 2E, wherein the corners of the final feature or etched block are substantially square and the measurement of FIG. 7 is relatively level when compared to the measurement of a rounded corner set out in FIG. 6.

The present process can be used to fabricate two or more partial etch features having substantially different contours in complex components or parts. For example, head suspension assemblies (HSA) that are used in rigid or hard disk information storage devices are complex components for supporting magnetic read/write transducers that "fly" in close proximity to a rotating disk in order to access information on the disk surface. The HSAs referred to are generally of the type known as a Watrous suspension system and are generally reported in U.S. Pat. Nos. 3,931,641 and 4,167,765.

In fabricating HSAs generally, and particularly for HSAs having integral flexure, load beam and spring region areas, it is necessary to fabricate a variety of complex features, such as the spring areas, edges, corners, surface textures, locating and aligning apertures, as well as to provide desirable contours such as complex tapers or areas of different thicknesses in the HSA. Controlled diffusion partial etching according to the present invention allows for optimal partial thickness etching coincident with the forming of thru-features, achieving desired dimensions and tolerances in both areas while using a single step partial etch process.

Figure 3:
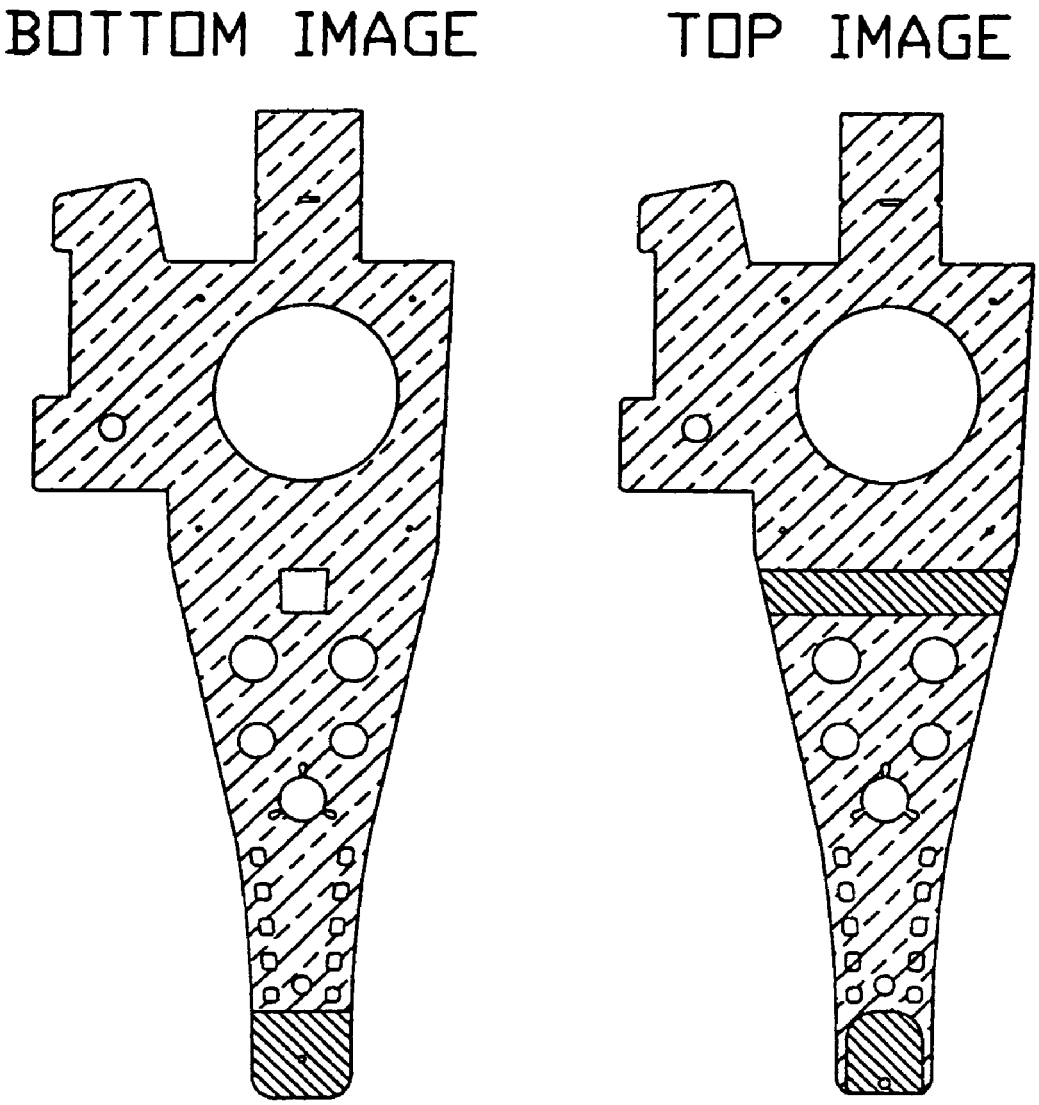
FIG. 3 is an illustration of top and bottom resist patterns for a conventional etch process.

FIG. 3 is an illustration of top and bottom resist patterns for a conventional or normal partial etch process. The patterns do not include areas that have resist mask land or open areas that alternatively may be referred to as "grayscale" areas. As a feature is formed during etching from the illustrated top and bottom resist mask patterns, there is no capability to control the contour of the feature or to control the etch rate in the transition areas of the substrate.

Figure 4:
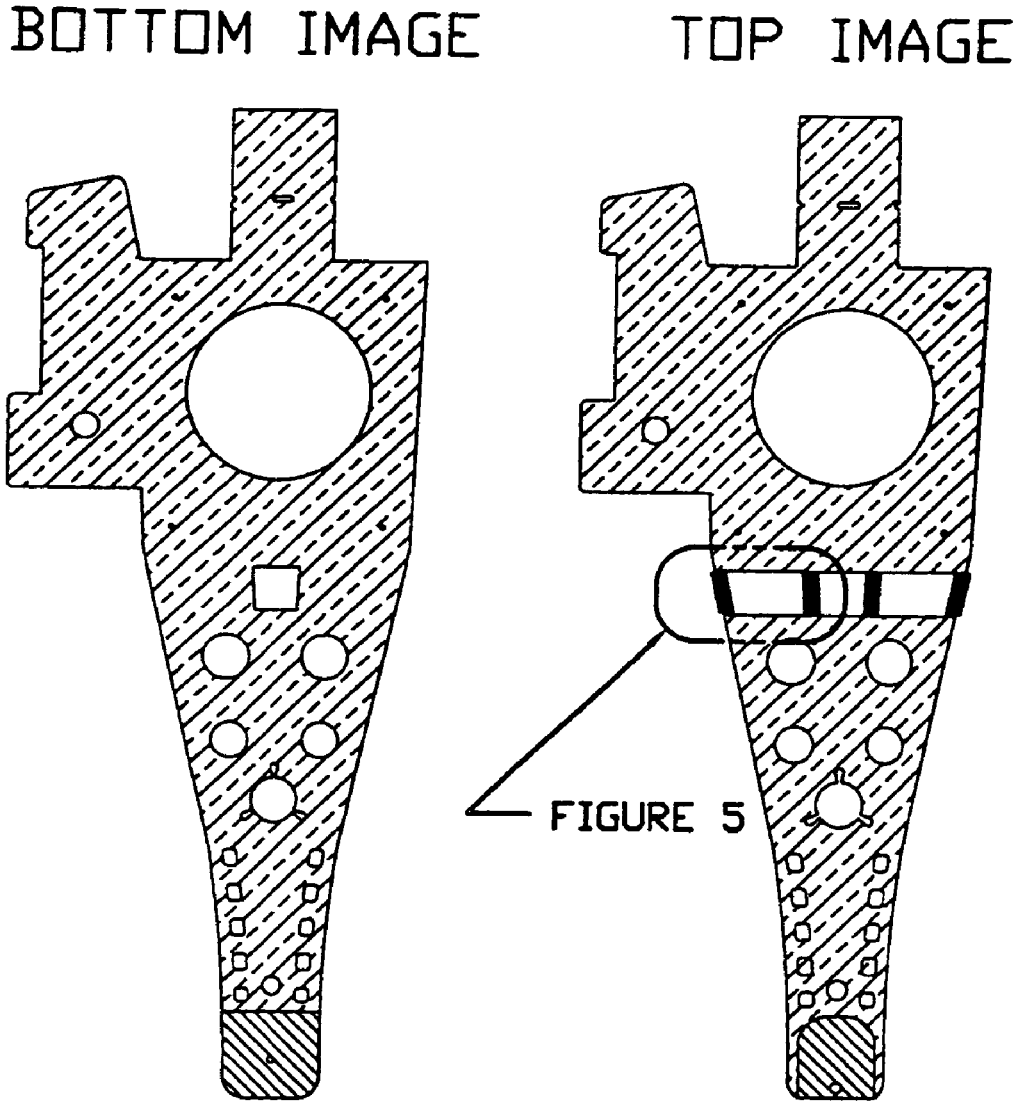
FIG. 4 is an illustration of top and bottom resist mask patterns for use in an etch process of this invention.

FIG. 4 is an illustration of top and bottom resist patterns for a partial etch process of this invention. In this figure, the top pattern includes "grayscale" areas that are made up of resist mask land areas (that are circular areas of resist that generally form pedestals during the etching process) and open areas (that are sections of the substrate that are not covered or protected by a resist layer and that generally are removed or etched away). These land areas and open areas control the relative rates of etching at a transition area of the substrate. A close-up of the inset of the top image of FIG. 4 is illustrated in FIG. 5, and also in the example below.

Figure 5:
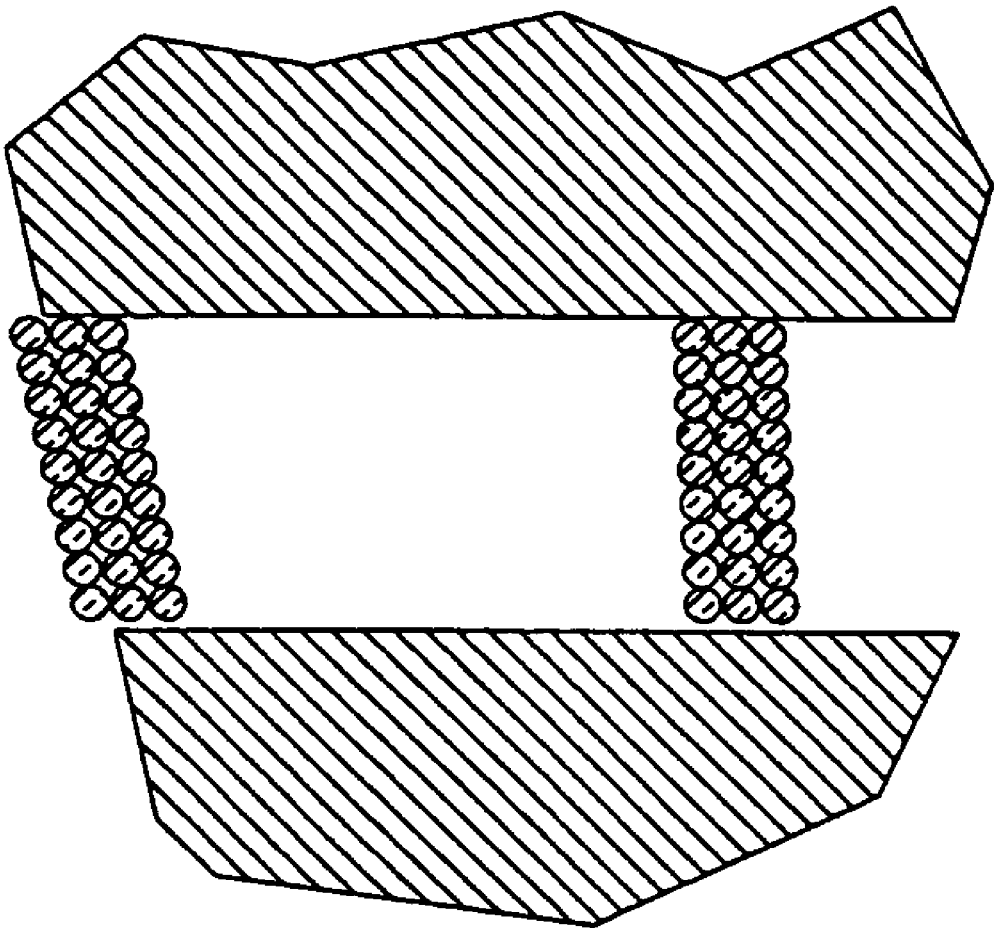
FIG. 5 is a close-up of the inset of the top image of FIG. 4.

As shown in the suspension assembly illustrated in FIGS. 3 and 4 and the enlarged detail thereof shown in FIG. 5, the spring region of the suspension assembly is provided with a suitable arrangement of land and mask areas in order to provide the suspension assembly with an optimized spring force.

Using the process according to the present invention, multiple contours or variations of contours of the substrate in the spring region may be fabricated in a single step etching procedure, without the cost, time and effort of carrying out additional separate expose and/or etch operations.

Use of a different pattern of line widths and spacings on other areas will produce a different effective etch rate and a different resulting thickness partial etch area for the same etching time.

As has been mentioned above, the controlled diffusion partial etch technique of the present invention is also used in fabricating the partial etch area in the spring region of the HSA illustrated in FIGS. 4 and 5. Using previously available etching processes, a major problem in fabricating such suspensions was that, in order to achieve a desired nominal remaining effective thickness in the partial etch area, a less than optimal compensation on the thru-features had to be accommodated.

Using the controlled diffusion partial etch process of this invention, controlled etching of partial etch portions may be combined with optimal contour of this feature so that the performance of this feature is more satisfactorily attained.

In addition to introducing areas of partial etching in the spring area of the suspension and in the flexure arms, it is also possible in accordance with the present invention to etch the loadbeam region to provide a contoured feature that provides enhanced performance of the suspension assembly.

Figure 9:
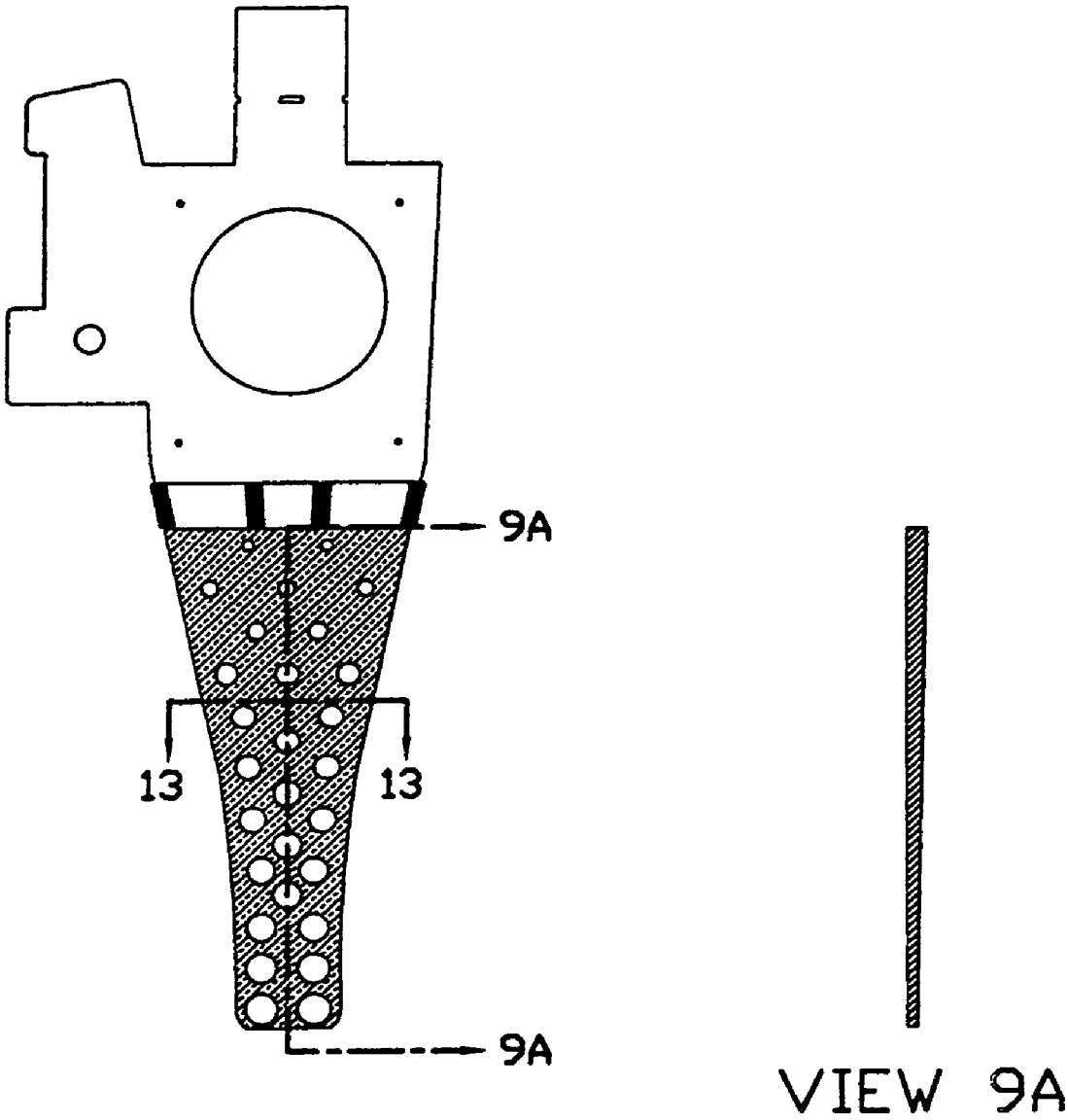
FIG. 9 is an illustration of a resist mask pattern having a pattern of resist areas that are free of resist for use in an etch process of this invention that provides a tapered complex part having a taper along it length as illustrated by view 9A.
Figure 10:
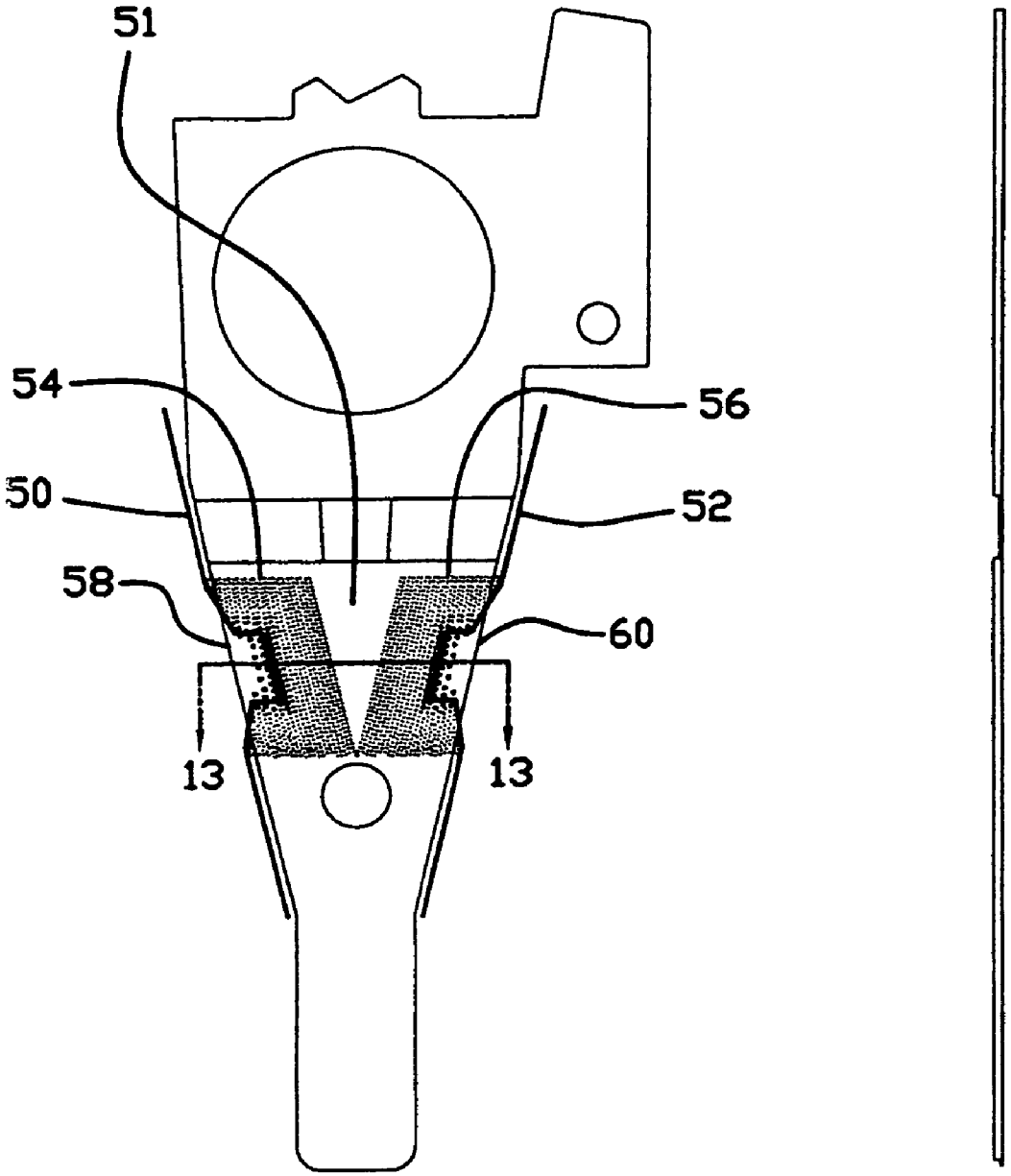
FIG. 10 is a plan view of a head suspension assembly having controlled contours in the load beam region of the head suspension assembly.
Figure 11:
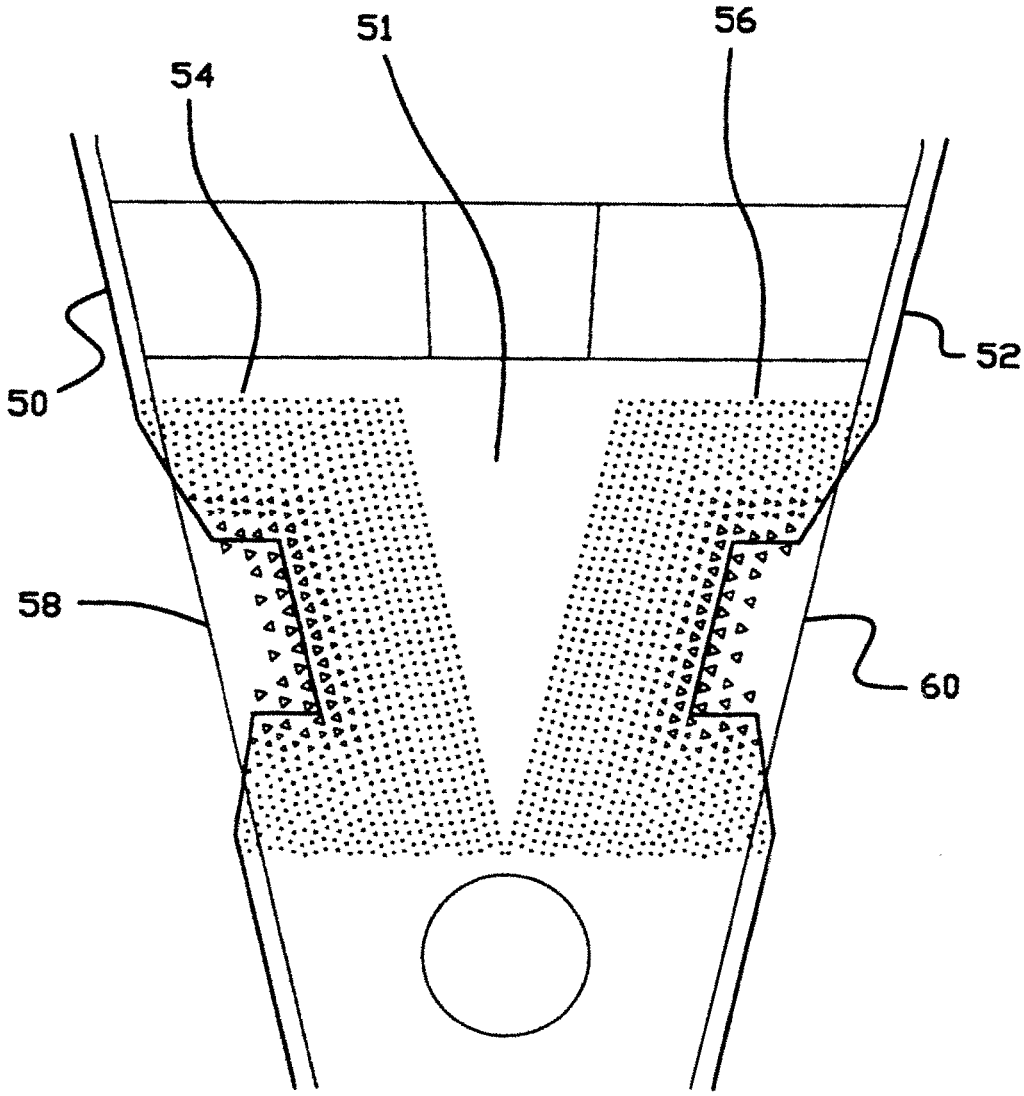
FIG. 11 is a plan view of one embodiment of a resist mask pattern used to control the contour of a feature in the load beam region of a head suspension assembly.
Figure 12:
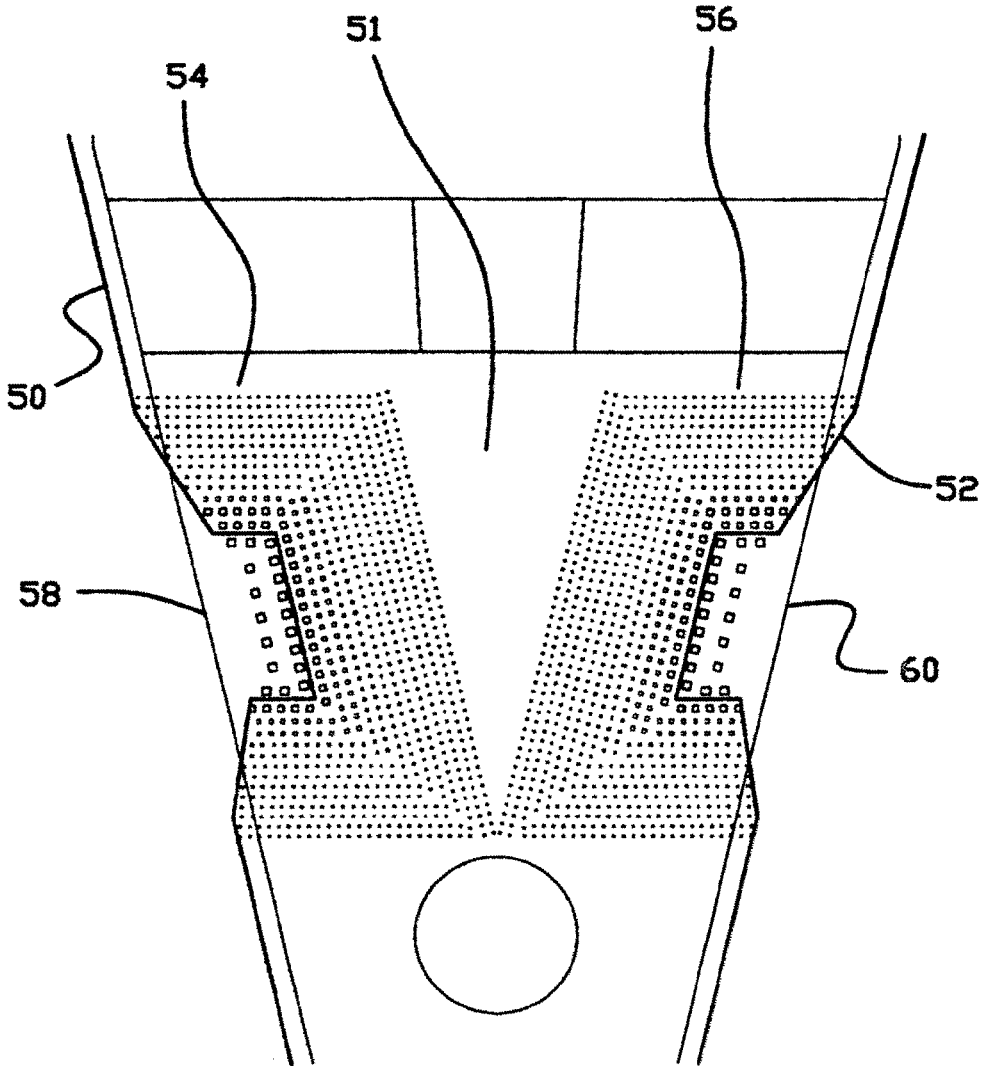
FIG. 12 is a plan view of one embodiment of a resist mask pattern used to control the contour of a feature in the load beam region of a head suspension assembly.

FIGS. 8–12 illustrate an etch process of the present invention wherein resist masks are patterned over the load beam portion of a head suspension assembly. For example, in FIG. 8, a plurality of mask land areas are patterned over the load beam region as part of an etching process that provides varying etch rates over the length of the load beam. In FIG. 9, a plurality of mask openings are patterned into a resist mask to produce an etch rate that varies over the length of the load beam. Both of these embodiments of the present invention may be used to provide a suspension assembly with a complex tapered geometry along the length of the load beam FIG. 10 illustrates a load beam 51 with a pattern of mask land areas and openings for an etch process providing an etch rate that generally increases from the center of the load beam to the outer edges 58 and 60 of the load beam. The V-shaped, unpatterned region of the load beam, generally bounded by patterned areas 54 and 56, is covered by a uniform layer of resist mask. The patterned areas 54 and 56 bounded by sectional lines 50 and 52 respectively, each illustrate a resist mask patterned with a series of mask openings that generally increase in size towards sectional lines 50 and 52. The areas bounded by sectional line 50 and outer edge 58 and sectional line 52 and outer edge 60 respectively, illustrate a resist mask opening patterned with several mask land areas that dissipate towards the outer edges 58 and 60 of the load beam. FIGS. 11 and 12 illustrate alternate embodiments of resist mask patterns that may be used in the etch process shown in FIG. 10. The etched load beam provided by the etch process illustrated in FIGS. 10–12 has generally rounded edges 58 and 60.

Figure 13:
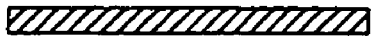
FIG. 13 illustrates examples of transverse cross sectional contours produced by the resist patterns illustrated in FIGS. 4, 5 and 8–12.
Figure 13:
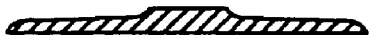
Figure 13:
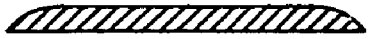
Figure 13:
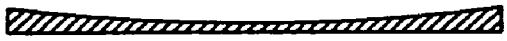

FIG. 13 illustrates several examples of transverse cross-sectional contours of suspension assemblies produced according to the etch process illustrated in FIGS. 4, 5 and 8–12.

Figure 14:
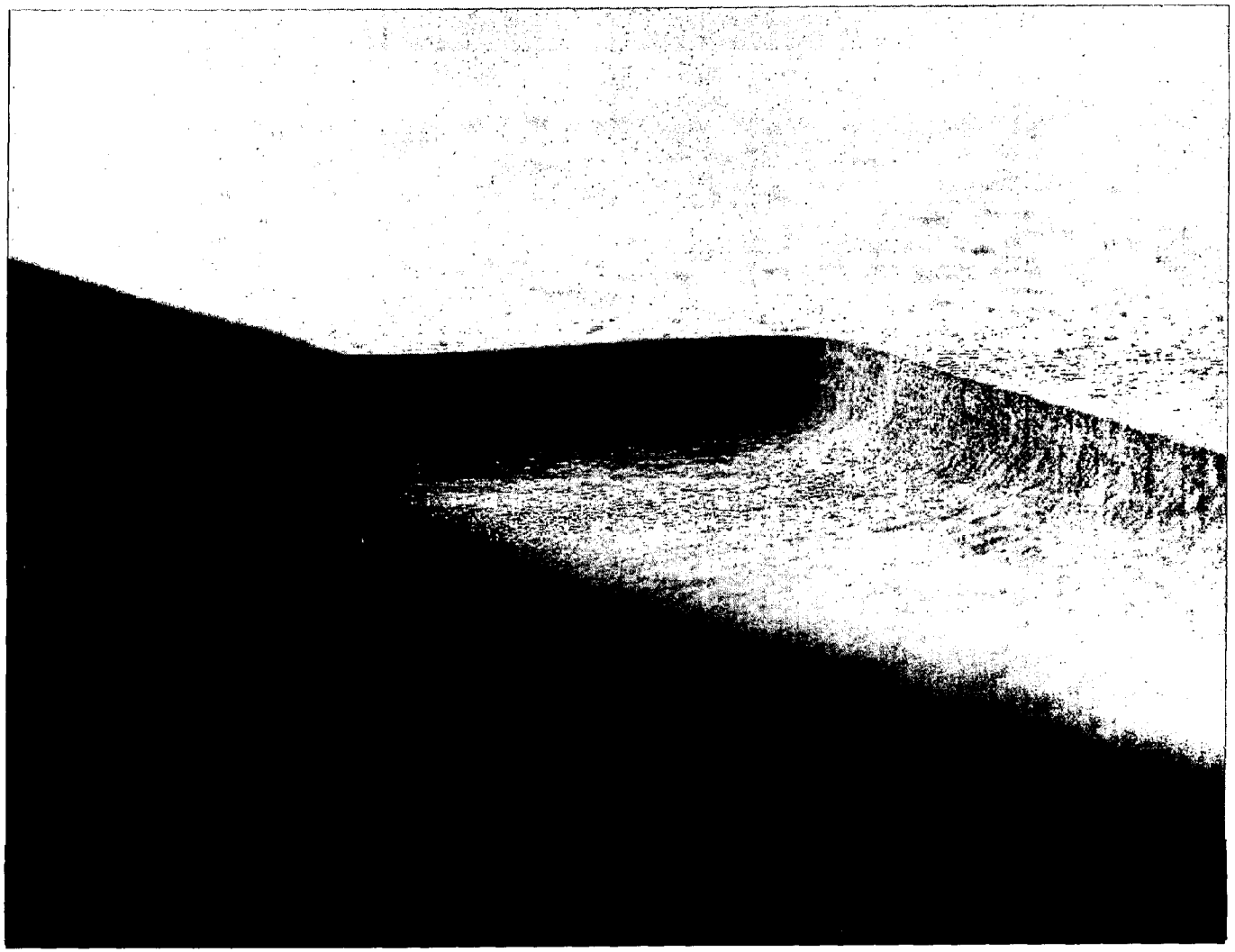
FIG. 14 is a digital image of a contoured substrate edge formed according to an embodiment of the present invention.
Figure 15:
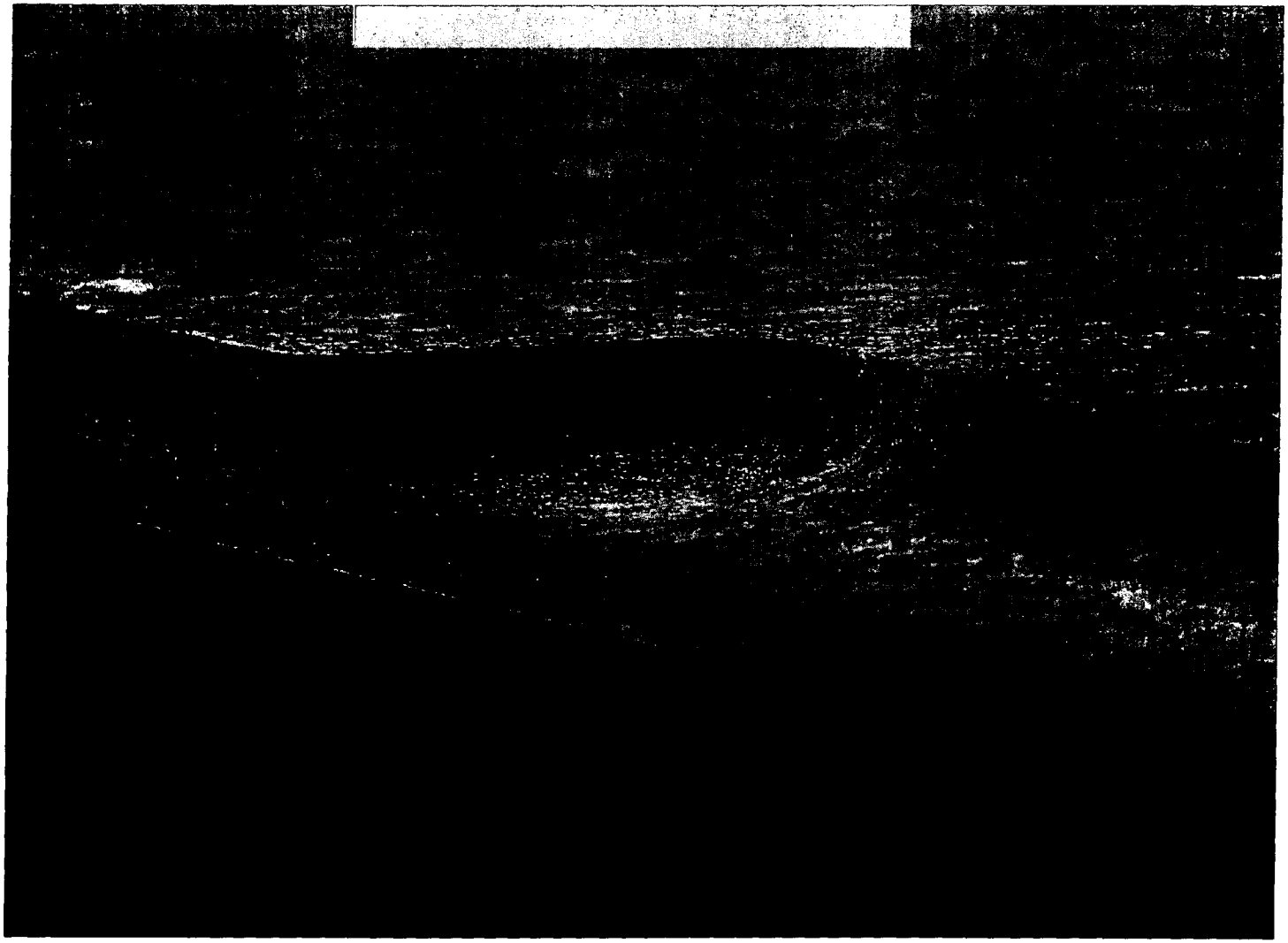
FIG. 15 is a digital image of a contoured substrate edge formed according to an embodiment of the present invention.
Figure 16:
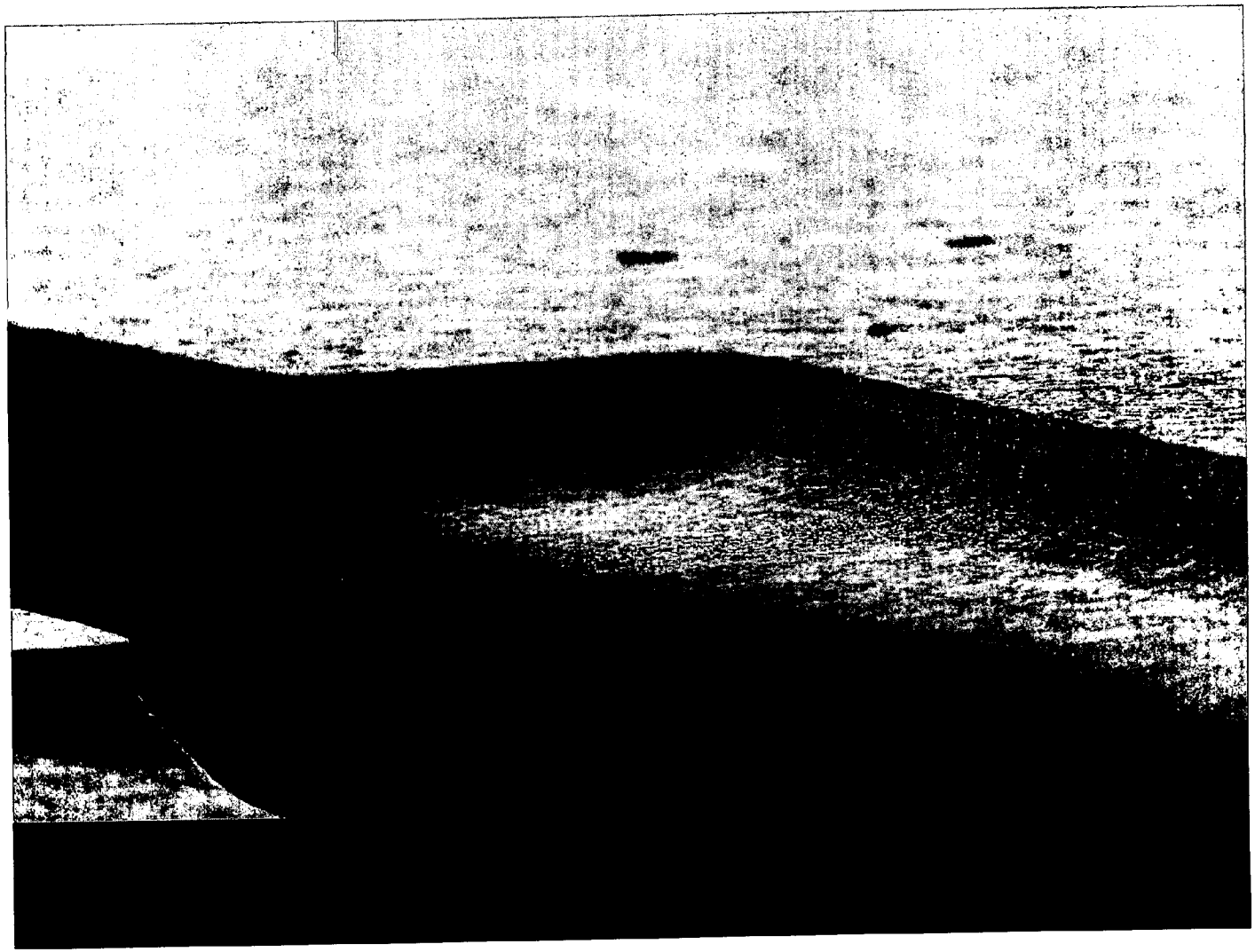
FIG. 16 is a digital image of a contoured substrate edge formed according to an embodiment of the present invention.
Figure 17:
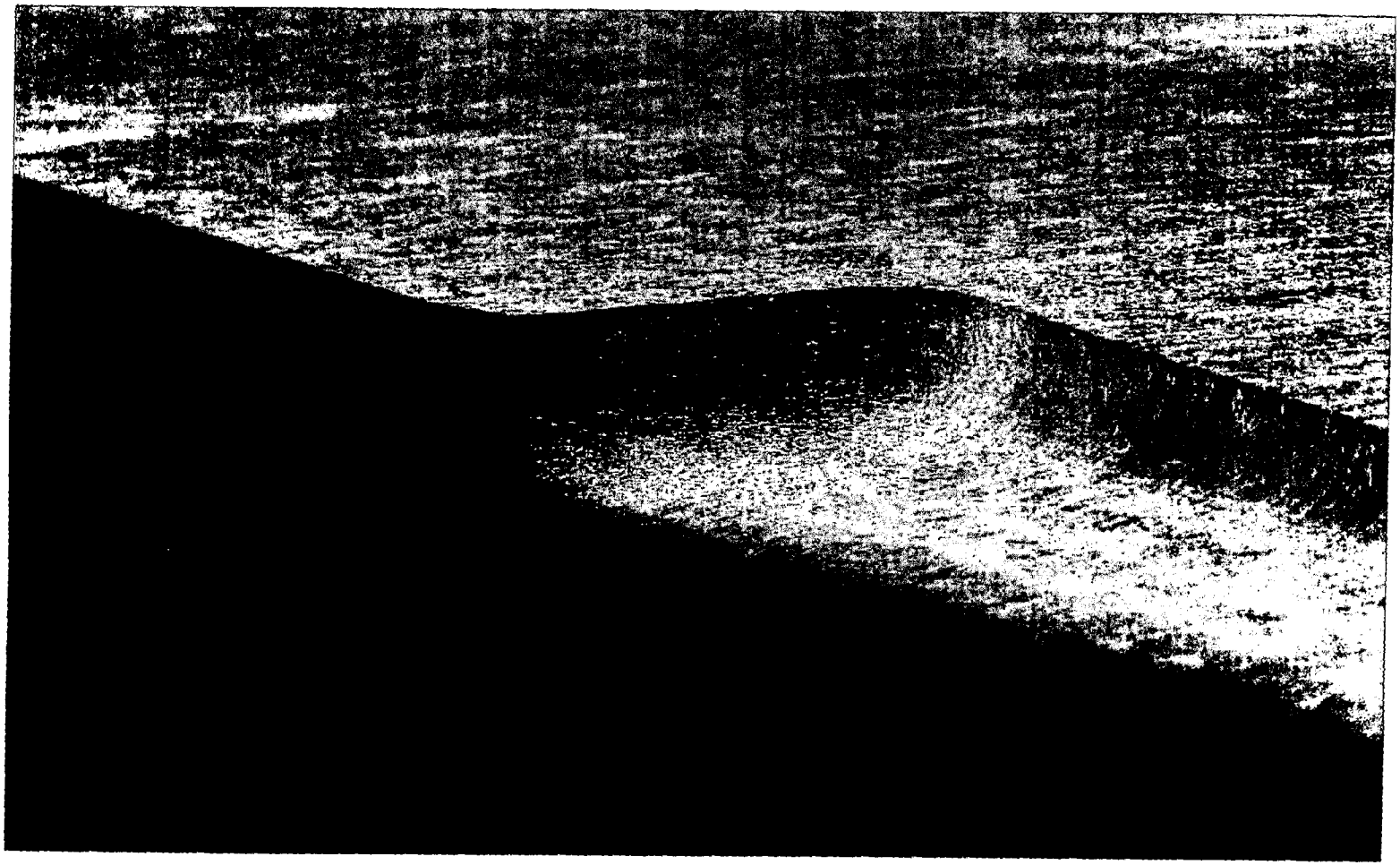
FIG. 17 is a digital image of a contoured substrate edge formed according to an embodiment of the present invention.

FIGS. 14–17 illustrate the controlled edge rounding characteristics of substrates formed according to embodiments of the present invention. FIG. 14 illustrates an edge rounding characteristic in which one additional gray scale resist line was positioned beyond the normal edge of the etched substrate. The embodiments illustrated in FIGS. 15–17 were formed by positioning two, three and four additional gray scale resist lines, respectively, beyond the normal edge of the etched substrate.

As shown in FIGS. 14–17, the thickness of the remaining metal at the edge of the transition area increases in thickness, and the radius of the contour changes as the number of additional lines increases. In this manner, the relative rounding of an edge of a substrate, or the location of the rounded edge within the vertical thickness of the substrate, may be increased or decreased as desired.

Figure 18:
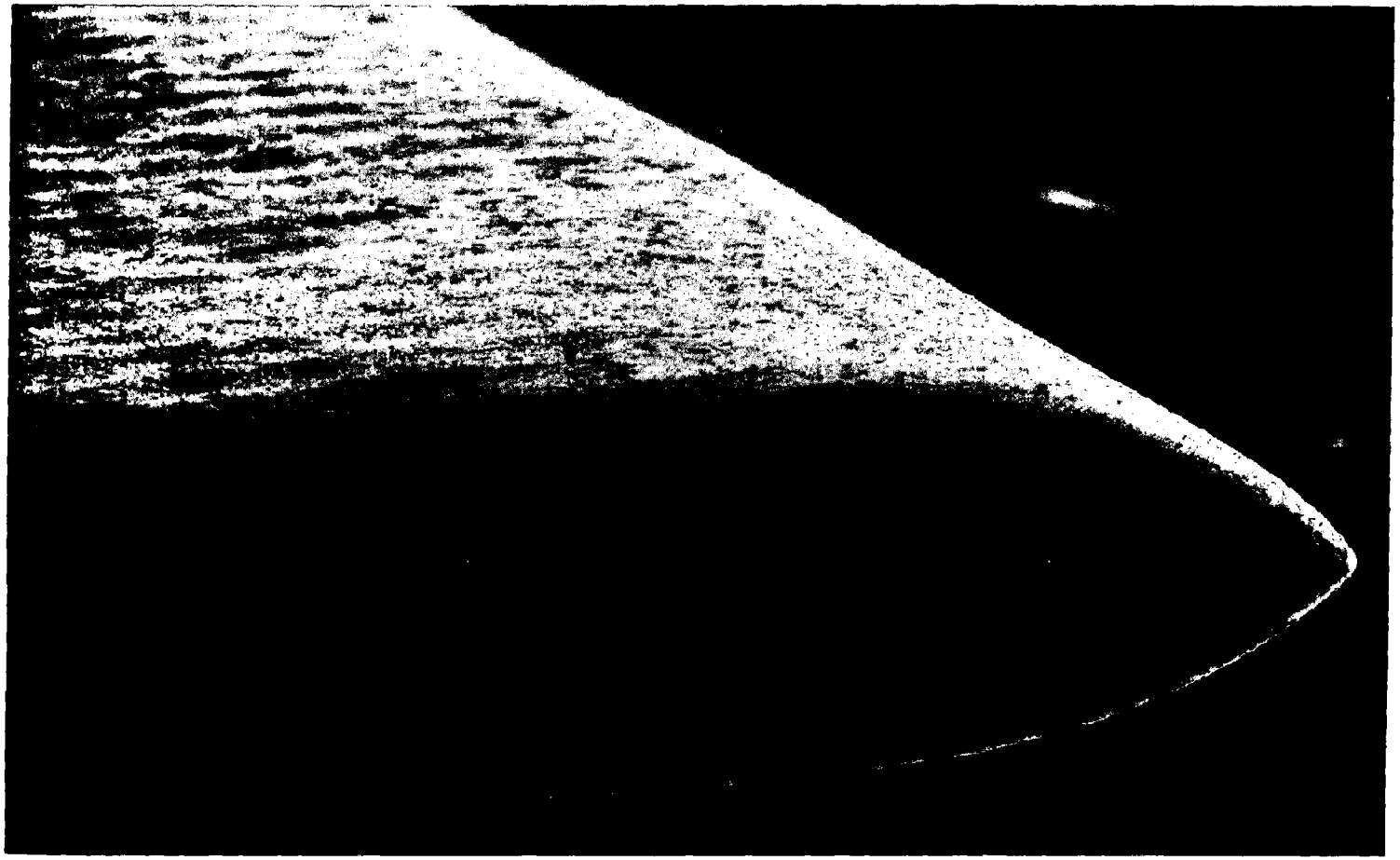
FIG. 18 is a digital image of a contoured substrate corner formed according to an embodiment of the present invention.
Figure 19D:
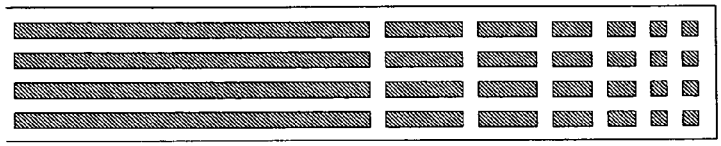
FIGS. 19*a*–*d* illustrates transition patterns for positioning between two different resist patterns on a substrate.
Figure 19C:
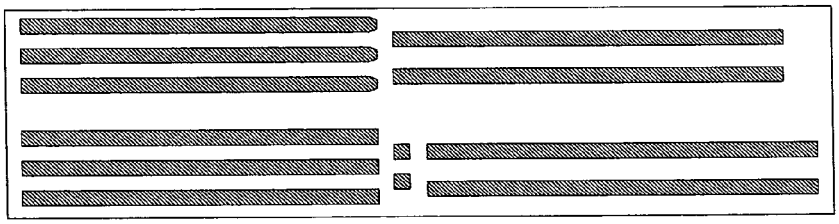
Figure 19B:
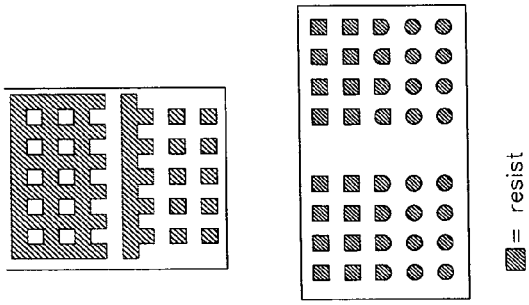
Figure 19A:
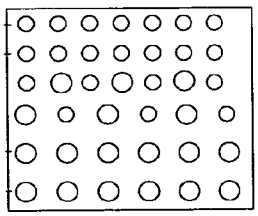

FIG. 18 illustrates a rounded corner profile of a load beam formed in a two-step etching process according to embodiments of the present invention. An etching step was performed on each side of a sheet to start the formation of the through features of the load beam. A partial etch pattern was then applied at the corner, and the entire load beam was etched. In this manner, a rounded corner was formed.

FIGS. 19*a*–*d* illustrates pattern transitions suitable for use in embodiments utilizing various patterns across a substrate or transition area. Such transition patterns include transition land areas and open areas, which may provide for an improved transition between different patterns on a substrate. Such pattern transitions may be particularly useful in the formation of a tapered substrate utilizing several different resist pattern shapes (e.g., dots, mesh, bars, etc.).

Figure 20:
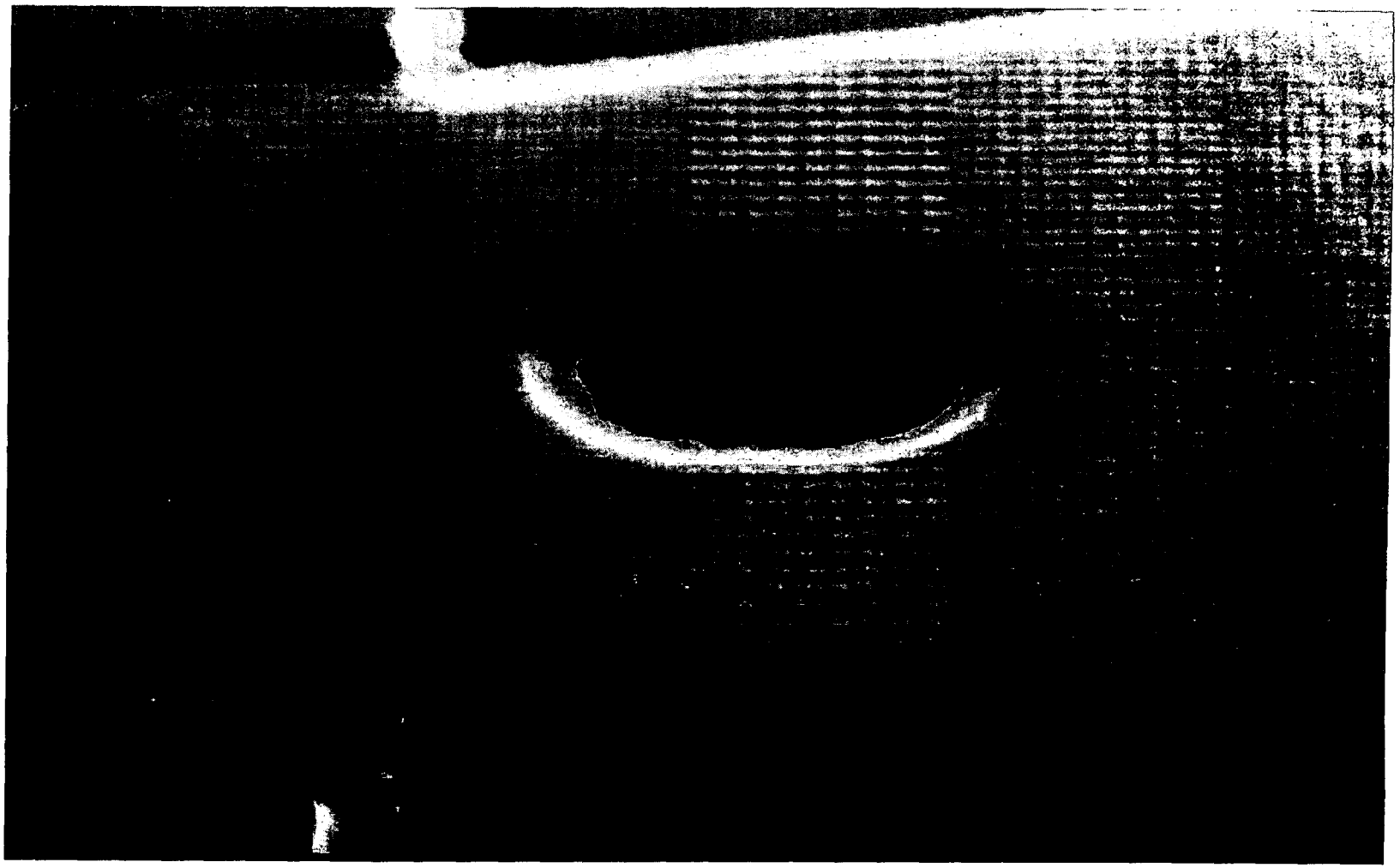
FIG. 20 is a digital image of a textured substrate surface formed according to an embodiment of the present invention.
Figure 21:
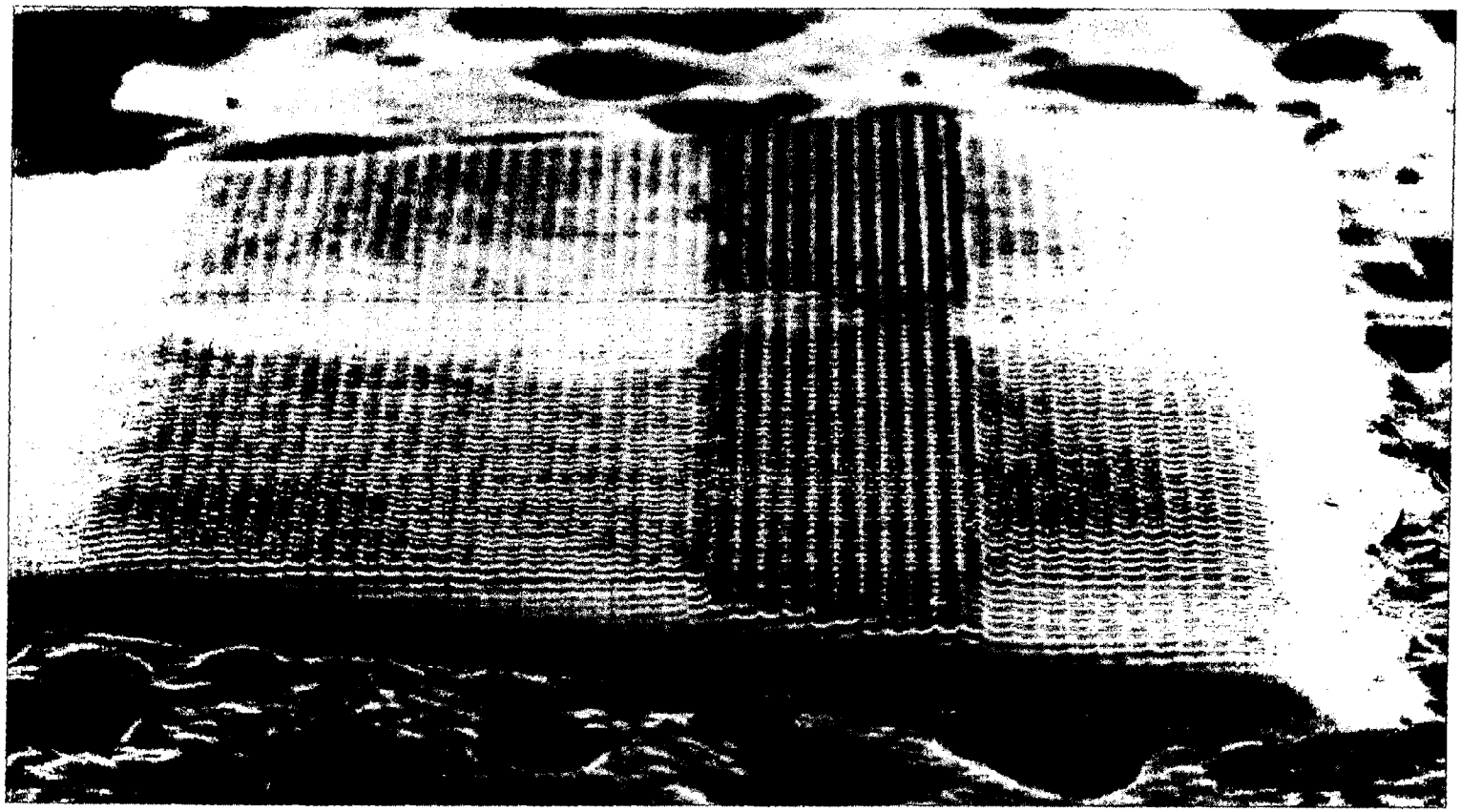
FIG. 21 is a digital image of a textured substrate surface formed according to an embodiment of the present invention.
Figure 22:
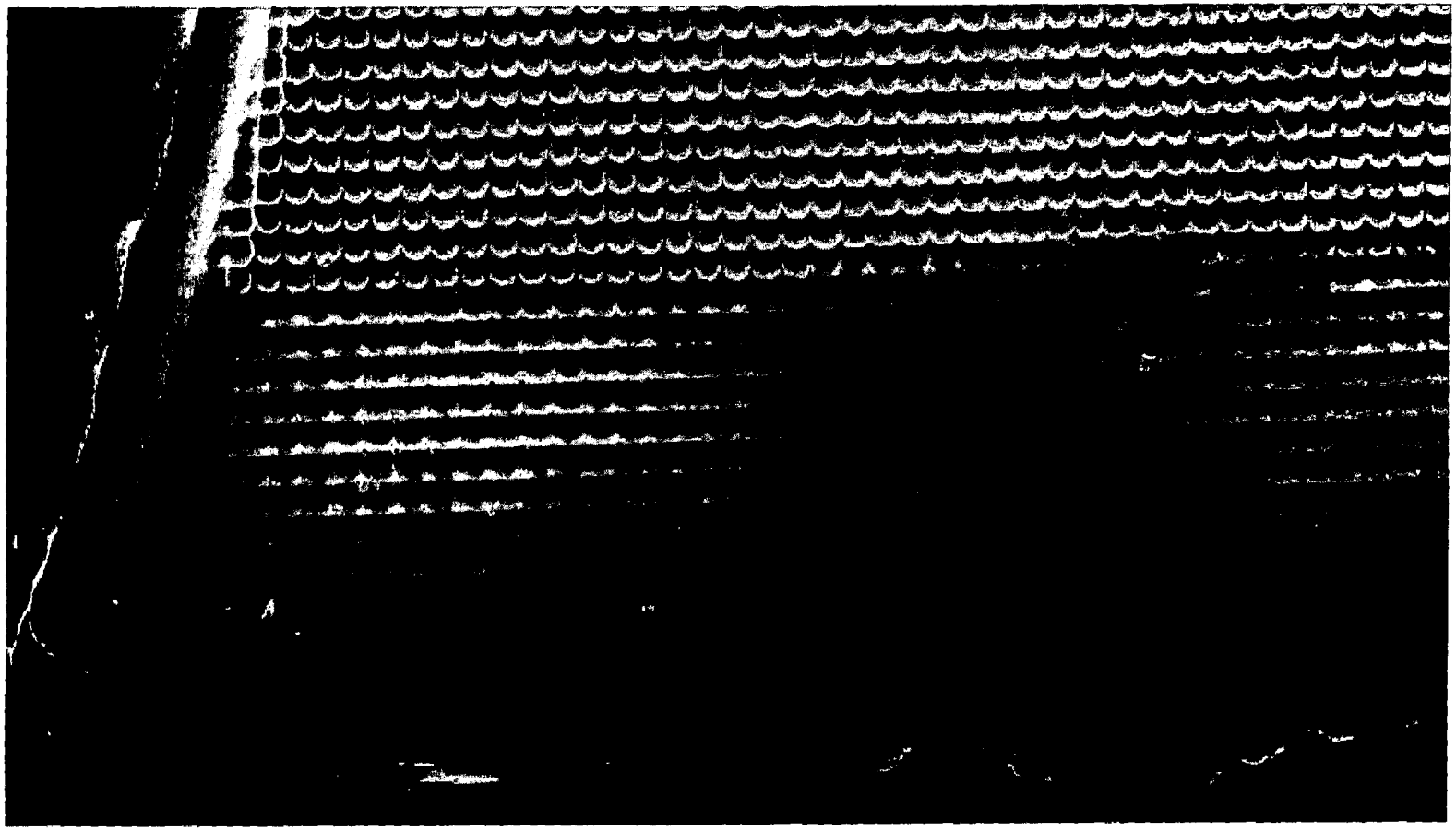
FIG. 22 is a digital image of a textured substrate surface formed according to an embodiment of the present invention.

FIGS. 20–22 illustrate varying degrees of texture that may be formed according to embodiments of the present invention. By varying the shape, size and thickness of the land areas, various textures, ranging from smooth to rough, may be formed on the substrates. Although smooth textures may be beneficial in most circumstances, a surface of increased texture may be useful, for example, at portions of the substrate in which additional materials are adhered to the surface of the substrate. The relative dimensions of this texturing may vary widely depending on the etch depth and the sizes of the photoresist land and open areas.

The previously described embodiments of the present invention may produce suspension assemblies with many performance characteristics, including improved resonance performance, improved spring constant accuracy, and decreased particulate matter generation. Not all of the performance characteristics need to be incorporated into every embodiment of the invention.

One performance characteristic of the present invention involves improved resonance performance in head suspension assemblies. Resonance vibrations are caused by the suspension assembly being constrained at one end while being free to vibrate at the other end. The degree of resonance is generally proportional to the amount of mass distributed towards the free end of the suspension assembly relative to the total mass of the suspension assembly. The etching process of the present invention described, for example in FIG. 8, may provide an etched suspension assembly with a load beam with a complex taper that minimizes the mass towards the free end of the assembly, resulting in improved resonance performance.

Another performance characteristic of the present invention is improved spring constant accuracy. During assembly of a suspension assembly into a disk drive, stress is placed along the spring region of the suspension assembly. A traditionally etched spring region, which possesses a generally convex surface, is subjected to uneven stress concentration in the spring region during assembly into the disk drive. This stress results in a greater chance of plastic deformation, which in turn, causes the spring constant to deviate from specification. The etching process of the present invention, however, provides a spring region with a flat surface, resulting in generally uniform stress distribution during assembly. The uniform stress distribution caused by the flat load beam substantially reduces deformation, and results in a spring constant that generally conforms to specification.

Yet another performance characteristic of the present invention is reduced particulate contamination caused when the merge comb contacts the head suspension assembly during merging of the head stack assembly into the disk stack. During assembly of head suspension assemblies into disk drives, a component called a merge comb contacts and elevates the suspension assembly for merging into the disks without interference. When the edge of the merge comb contacts the edges of a suspension assembly, the comb scrapes along the edge, damaging the merge comb and generating particulate contamination in the disk drive. However, the round edges provided by an embodiment of the present invention provide a smoother surface for the comb to contact, thereby minimizing merge comb damage and particulate contamination in the disk drive.

One of skill would appreciate how the process of the present invention and these same ideas could be used, by proper selection of the size and positions of the resist land areas, to control contours associated with the formation of features incorporated into or on other etched and partially etched substrates. While general principles of the invention are described above, routine experimentation will be effective in identifying optimal conditions and parameters of the present process such as land and open area size, shape, and spacing, to accomplish any particularly desired result such as but not limited to a topography, cross-section, or partial etch depth of a thin or very thin substrate.

EXAMPLE 1

In this example, a feature is formed on a stainless steel substrate by partially etching one region of the substrate from an original thickness of 102 microns to a final thickness of 25 microns. The adjacent area on the substrate is etched completely away. The edge of the retained feature is produced with a sharp corner by forming a pattern of three rows of resist areas at the edge of the feature. Only one surface of the substrate is partially etched. The other surface of the substrate is completely covered with resist material including the area to be partially etched as well as the area to be completely etched away.

Three rows of circular-shaped resist areas or dots are used to create a square edge on a feature formed by a partial etch of an area of a stainless steel substrate. The resist areas are formed from a photoresist sold under the trade designation, Photoposit SP 23-1 Photoresist, by Shipley Ronal Company, Marlborough, Mass. The pattern is generated using a known process when the photoresist material is selectively exposed to UV light.

The middle row is a series of circular-shaped resist areas or dots in which each dot has a diameter of 55 microns and the center of each dot is spaced 90 microns apart in the row. The edges of the dots in this row are 35 microns apart. This middle row is centered on the line formed by the edge of the feature that is produced by partially etching the substrate. The bottom row is outside of the edge of the feature in the region of the substrate that will be etched away during the process. The series of dots in this row have diameters of 70 microns and the center of each dot is also spaced 90 microns apart. The edges of the dots in this row are 20 microns apart. The line made by the centers of the dots in this row are 69.1 microns apart from the line made by the centers of the dots in the middle row. In addition, the centers of the dots in the bottom row are offset 45 microns from the centers of the dots in the middle row when the distance is measured in a direction that is perpendicular to lines formed by the bottom and middle rows. The top row of dots is located in the area of the feature which is partially etched but retained on the substrate. This row is made of a series of dots in which each dot has a diameter 55 microns and the center of each dot is spaced 90 microns apart. The line made by the centers of the dots in this row are 60 microns from the line made by the centers of the dots in the middle row. In addition, the centers of the dots in the bottom row are offset 45 microns from the centers of the dots in the middle row when the distance is measured in a direction that is perpendicular to lines formed by the bottom and middle rows.

After the resist pattern is formed, the exposed areas of the substrate are etched by using aqueous ferric chloride solutions using common techniques.

The resist pattern formed by three rows of dots provides a sharp corner on the edge of the feature that is produced by partially etching an area of the substrate.

EXAMPLE 2

Figure 23:
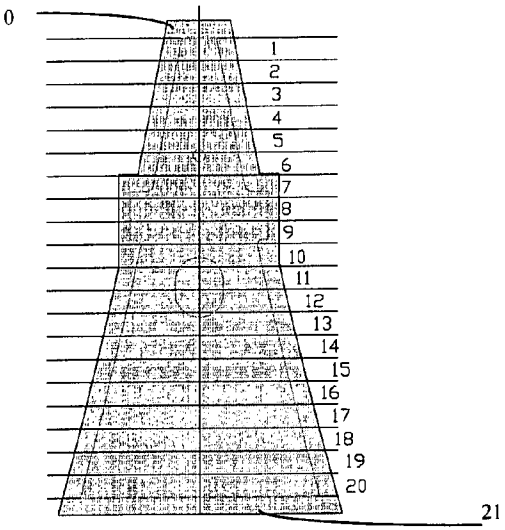
FIGS. 23*a*–*b* illustrates a resist pattern used in Example 2 to form a tapered substrate.
Figure 23:
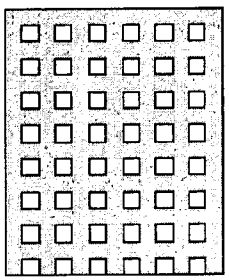

A tapered stainless steel substrate was formed by applying a resist pattern over 22 discrete regions or zones of a substrate having an original thickness of 0.010 inches. FIGS. 23*a–b* schematically illustrates the square mesh pattern used in each of the 22 zones. Table 1 below shows the resist area size and open area size in each of these zones. The resist pattern was formed according to Example 1, and the substrate was subsequently etched using aqueous ferric chloride.

TABLE 1

| Zone | Resist Area Size (mm) | Opening Area Size (mm) |
|---|---|---|
| 0 | 0.032 | 0.032 |
| 1 | .0031 | 0.031 |
| 2 | 0.030 | 0.030 |
| 3 | 0.029 | 0.029 |
| 4 | 0.028 | 0.028 |
| 5 | 0.027 | 0.027 |
| 6 | 0.026 | 0.026 |
| 7 | 0.025 | 0.025 |
| 8 | 0.024 | 0.024 |
| 9 | 0.023 | 0.023 |
| 10 | 0.022 | 0.022 |
| 11 | 0.020 | 0.020 |
| 12 | 0.0204 | 0.020 |
| 13 | 0.0208 | 0.020 |
| 14 | 0.0212 | 0.020 |
| 15 | 0.0216 | 0.020 |
| 16 | 0.0220 | 0.020 |
| 17 | 0.0227 | 0.020 |
| 18 | 0.0235 | 0.020 |
| 19 | 0.0242 | 0.020 |
| 20 | 0.0250 | 0.020 |
| 21 | 0.0257 | 0.020 |

Figure 24:
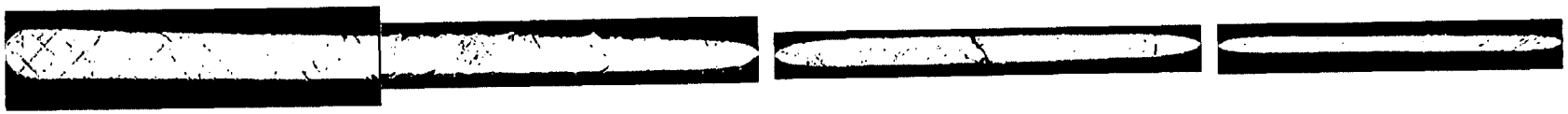
FIG. 24 is a series of digital images depicting the cross-section of a tapered substrate formed according to the method of Example 2.

The presence of the discrete resist pattern in each zone resulted in an etch rate that varied between each zone. Generally speaking, the etch rate decreased from zone 0 to zone 21 such that a tapered substrate was formed. During etching, the resist areas became detached from the substrate due to undercutting caused by the etchant. A cross-section of the tapered substrate is depicted in FIG. 24, which includes a series of photographs approximately spanning zones 1–5, 6–10 and 13–20, respectively, of the substrate when viewed from right to left.

Figure 25:
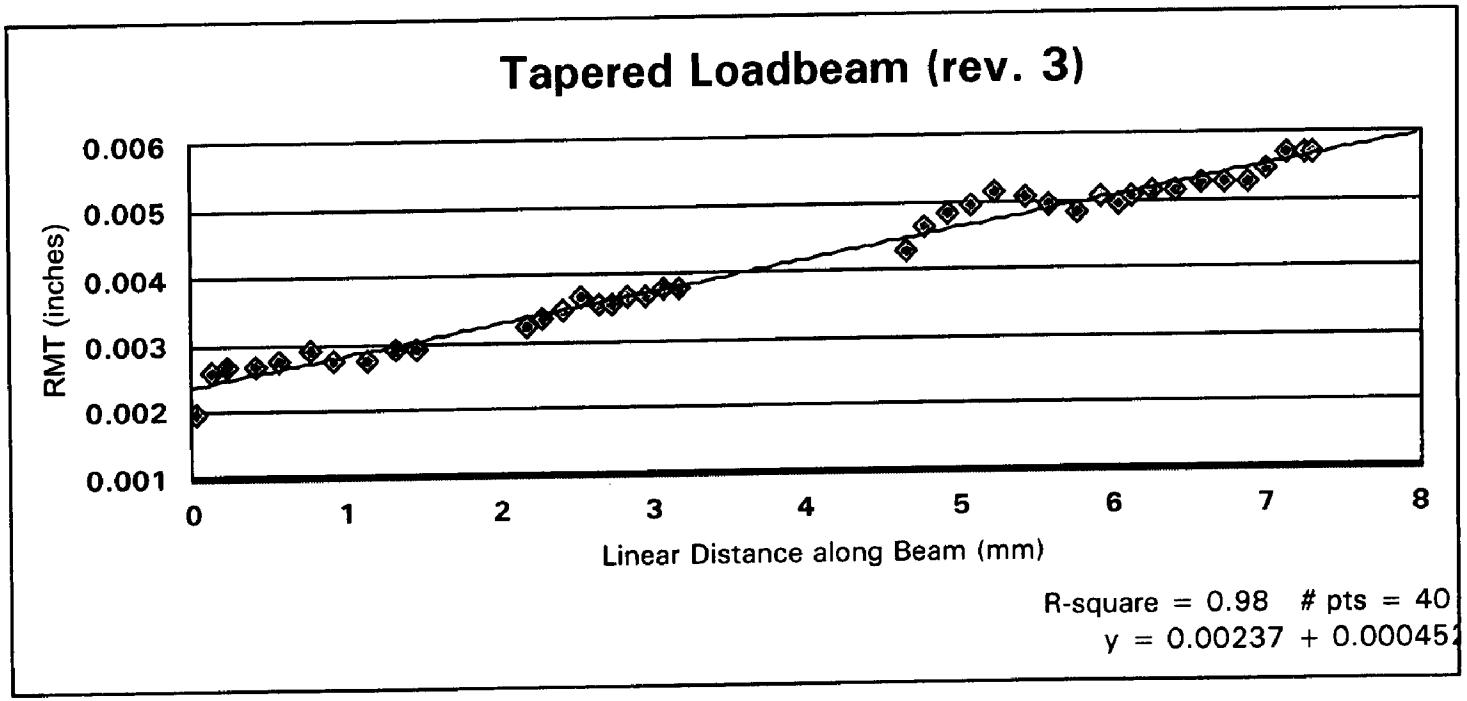
FIG. 25 illustrates a graph of the substrate thickness at various points along a substrate formed according to the method of Example 2.

The resulting substrate had a final thickness ranging from 0.002 inches at zone 20 to about 0.0058 inches at zone 1. The graph illustrated in FIG. 25 illustrates the linear relationship of the thickness of the substrate across the substrate zones. The gaps at about 2 mm and about 4 mm indicate locations of complete etching of the substrate. As illustrated in FIG. 25, embodiments of the present invention may form incrementally and/or linearly tapered substrates.

What is claimed is:

1. A process for controlling the contour of a transition area of a feature made by etching a substrate comprising applying a patterned resist mask to the substrate to form a plurality of mask openings and mask land areas having mask land areas which are sized and spaced to control the contour of a transition area of the feature wherein the size and spacing of the land areas provide an etch depth in the substrate at the transition area that is less than an etch depth at an adjacent etched or partially etched area of the substrate and etching the substrate to provide a contoured feature at the transition area.

2. The process of claim 1 wherein the width and spacing of mask land areas provide a slower etch rate than an etch rate at an adjacent etched or partially etched area of the substrate.

3. The process of claim 1 wherein the mask land areas are circular, elliptical, square, rectangular, triangular, hexagonal, pentagonal, trapezoidal or a combination of such shapes.

4. The process of claim 1 wherein the patterned resist mask comprises a mesh pattern of mask land areas and mask openings.

5. The process of claim 1 wherein the patterned resist mask comprises mask land areas having at least two distinct shapes or sizes.

6. The process of claim 5 wherein the patterned resist mask comprises transition mask land areas positioned between the at least two distinct shapes or sizes.

7. The process of claim 1 wherein the mask land areas are circles having diameters in the range from about 10 to 100 microns.

8. The process of claim 7 wherein the circular land areas have diameters in the range from about 55 to 70 microns.

9. The process of claim 7 wherein the circular land areas have diameters in the range from about 20 to 30 microns.

10. The process of claim 7 wherein the edges of the circular land areas are spaced at a distance in the range from about 10 to 50 microns.

11. The process of claim 1 wherein the contoured feature comprises a taper, a sharp edge, a corner, a slope or a rounded edge.

12. The process of claim 1 further comprising etching the substrate prior to applying the patterned resist mask to the substrate.

13. The process of claim 1 wherein the contour of the transition area comprises a controlled cross section or topography of the transition area.

14. The process of claim 13 wherein the transition area comprises a fillet radius.

15. The process of claim 13 wherein the transition area comprises a corner.

16. The process of claim 13 wherein the transition area comprises a slope.

17. The process of claim 13 wherein the transition area comprises a rounded or sharp edge.

18. The process of claim 13 wherein the transition area comprises a taper.

19. The process of claim 1 wherein the size, shape, and spacing of the plurality of mask land areas and the size, shape, and spacing of the one or more mask open areas reduce corner rounding of a feature at the transition area.

20. The process of claim 1 wherein the plurality of mask openings and mask land areas comprise a first mask area of a first predetermined planar size and planar shape to form a plurality of first mask openings and first mask land features that are dimensioned to provide a first area etch depth, a second mask area of a second predetermined planar size and planar shape to form a plurality of second mask openings and second mask land features dimensioned to provide a second area etch depth, wherein the second area etch depth is reduced relative to the first area etch depth, and at least a third mask area of a third predetermined planar size and planar shape to form a plurality of third mask openings and third mask land features dimensioned to control a contour of a transition area located adjacent to the first and second mask areas, wherein etching the substrate results in the substrate corresponding to the second mask area etched to a lesser depth than the substrate corresponding to the first mask area, and results in the transition area adjacent to the first and second mask areas comprising a contoured feature.

21. The process of claim 1 wherein the contour of the transition area comprises a tapered substrate formed by incrementally increasing an etch rate from a first end of the substrate to a second end of the substrate, and etching the substrate such that the etch depth incrementally increases from the first end to the second end of the substrate to form the tapered substrate.

22. The process of claim 21 wherein the substrate comprises a plurality of zones, each zone including land mask areas having a different mask size than the land mask areas in at least one other zone.

23. The process of claim 22 wherein each zone includes mask openings having a different opening size than the mask openings in at least one other zone.

24. The process of claim 21 wherein the etch depth substantially linearly increases from the first end to the second end of the substrate.

25. The process of claim 22 wherein each zone includes land mask areas having a different shape than the land mask areas in at least one other zone.

26. The process of claim 21 wherein the patterned resist mask comprises a square mesh of open areas and land mask areas.

27. The process of claim 21 wherein the patterned resist mask comprises circles, rectangles, squares, lines or combinations thereof.

28. The process of claim 1 wherein the contour of the transition area comprises a textured substrate surface.

29. The process of claim 28 wherein the textured substrate surface is smooth or rough.

30. The process of claim 28 wherein the textured substrate surface comprises varying degrees of texture.

* * * * *